US011168712B2

(12) United States Patent
Zent et al.

(10) Patent No.: US 11,168,712 B2
(45) Date of Patent: Nov. 9, 2021

(54) HYDRAULIC LEVELING CIRCUIT FOR POWER MACHINES

(71) Applicant: Clark Equipment Company, West Fargo, ND (US)

(72) Inventors: Kevin Zent, Bismarck, ND (US); David Glasser, Bismarck, ND (US); Scott LaCoe, Bismarck, ND (US); Daniel Krieger, Bismarck, ND (US); Matthew Kaldor, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 16/799,685

(22) Filed: Feb. 24, 2020

(65) Prior Publication Data

US 2020/0270846 A1 Aug. 27, 2020

Related U.S. Application Data

(60) Provisional application No. 62/809,275, filed on Feb. 22, 2019.

(51) Int. Cl.
*F15B 11/22* (2006.01)

(52) U.S. Cl.
CPC ..... *F15B 11/22* (2013.01); *F15B 2211/4053* (2013.01); *F15B 2211/40546* (2013.01)

(58) Field of Classification Search
CPC ..... F15B 11/22; F15B 2211/782; F15B 2211/4053; F15B 2211/40523; F15B 2211/40546; E02F 3/433
See application file for complete search history.

(56) References Cited

U.S. PATENT DOCUMENTS 3,179,120 A 4/1965 Erickson
3,251,277 A 5/1966 Stacey
(Continued)

FOREIGN PATENT DOCUMENTS

AU 608712 B2 4/1991
EP 0391808 A1 10/1990
(Continued)

OTHER PUBLICATIONS

International Searching Authority, International Search Report and Written Opinion for application PCT/US2020/019545. dated May 19, 2020.

*Primary Examiner* — F Daniel Lopez

(57) ABSTRACT

A hydraulic assembly for an extendable lift arm assembly can include an extension cylinder, a leveling cylinder, a main control valve, a flow combiner/divider, and one or more flow-blocking arrangements. The main control valve can be configured to control commanded movement of the extension and leveling cylinders of the lift arm assembly. The flow combiner/divider can be configured to hydraulically link the extension cylinder with the leveling cylinder for synchronized operation of the extension cylinder and the leveling cylinder. The one or more flow-blocking arrangements can be configured to restrict flow from rod or base ends of the leveling or extension cylinders during commanded extension or retraction of the leveling and extension cylinders, or in the absence of commanded movement of the leveling and extension cylinders, to maintain synchronized orientation of the leveling and extension cylinders.

24 Claims, 9 Drawing Sheets

(56) References Cited

U.S. PATENT DOCUMENTS

| | | | |
|---|---|---|---|
| 3,657,969 | A | 4/1972 | Wirkus |
| 3,792,792 | A | 2/1974 | Bromberek |
| 3,952,896 | A | 4/1976 | Hayward |
| 3,987,920 | A | 10/1976 | Parquet |
| 4,408,518 | A | 10/1983 | Diel |
| 4,683,802 | A | 8/1987 | Prokop |
| 4,709,618 | A | 12/1987 | Zongker |
| 4,815,357 | A | 3/1989 | Truehart |
| 4,844,685 | A | 7/1989 | Sagaser |
| 4,923,362 | A | 5/1990 | Fryk |
| 5,016,767 | A | 5/1991 | Thibault |
| 5,082,085 | A | 1/1992 | Ream |
| 5,234,312 | A | 8/1993 | Hirose |
| 5,797,310 | A | 8/1998 | Casey |
| 6,267,041 | B1 | 7/2001 | Skiba |
| 6,308,612 | B1 | 10/2001 | Emanie |
| 6,389,953 | B1 | 5/2002 | Altman |
| 6,557,276 | B2 | 5/2003 | Contoli |
| 7,044,705 | B2 | 5/2006 | Way |
| 7,093,383 | B2 | 8/2006 | Mennen |
| 7,409,825 | B2 | 8/2008 | Stephenson |
| 7,607,381 | B2 | 10/2009 | Kauss |
| 7,856,282 | B2 | 12/2010 | Tabor |
| 8,726,786 | B2 * | 5/2014 | Miki ..... E02F 9/2267 91/515 |
| 8,833,067 | B2 | 9/2014 | Opdenbosch |
| 9,272,888 | B2 | 3/2016 | Owston |
| 9,796,571 | B2 | 10/2017 | Singh |
| 2001/0015129 | A1 | 8/2001 | Altman |
| 2005/0210713 | A1 | 9/2005 | Mennen |
| 2007/0163259 | A1 | 7/2007 | Webster |
| 2018/0171578 | A1 | 6/2018 | Smekel |

FOREIGN PATENT DOCUMENTS

| | | | |
|---|---|---|---|
| FR | 1401412 | A | 6/1965 |
| JP | H0960032 | A | 3/1997 |
| WO | 2017164785 | A1 | 9/2017 |

* cited by examiner

HYDRAULIC LEVELING CIRCUIT FOR POWER MACHINES

CROSS-REFERENCE TO RELATED APPLICATIONS

This application claims priority to U.S. Provisional Patent Application No. 62/809,275, filed Feb. 22, 2019, the entirety of which is incorporated herein by reference.

BACKGROUND

This disclosure is directed toward power machines. More particularly, this disclosure is directed toward leveling systems for buckets or other implements on lift arm assemblies of power machines, including compact articulate loaders with extendable (e.g., telescoping) lift arm assemblies.

Power machines, for the purposes of this disclosure, include any type of machine that generates power to accomplish a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Different types of power machines, such as articulated and other loaders, can include lift arm assemblies, such as may be used to execute work functions using implements secured to the lift arm assemblies. For example, hydraulic circuits can be operated to move a lift arm assembly to raise or lower, or otherwise manipulate, a bucket or other implement that is coupled to a lift arm of the lift arm assembly. As a bucket or other implement is raised and lowered, or otherwise manipulated, it can be advantageous to control the attitude of the implement (i.e., the orientation of the implement relative to ground, a horizontal plane, or another reference), such as to maintain the implement at an appropriately constant attitude (e.g., substantially parallel to ground).

The discussion above is merely provided for general background information and is not intended to be used as an aid in determining the scope of the claimed subject matter.

SUMMARY

Some power machines, such as front-end loaders and utility vehicles, can include telescoping lift arm assemblies and associated hydraulically operated implement-leveling systems. In some embodiments of the disclosure, an implement-leveling system can include a hydraulic leveling circuit that can provide improved leveling performance, including with regard to particular modes of operation in which particular hydraulic cylinders of the implement-leveling systems may be subjected to particular types of loading (e.g., compression or tension). For example, some embodiments of the disclosure can include appropriately placed and configured restriction orifices that are configured to prevent run out or desynchronization of various hydraulic cylinders within the hydraulic leveling circuit during particular work operations.

In some embodiments, a hydraulic assembly for a telescoping lift arm assembly is provided. The telescoping lift arm assembly can include a main lift arm portion, a telescoping lift arm portion configured to move telescopically relative to the main lift arm portion, and an implement supported by the telescoping lift arm portion. The hydraulic assembly can include an extension cylinder, a leveling cylinder, a main control valve, a flow combiner/divider, a first restriction orifice, and a second restriction orifice. The extension cylinder can be configured to move the telescoping lift arm portion relative to the main lift arm portion. The leveling cylinder can be configured to adjust an attitude of the implement relative to the telescoping lift arm portion. The main control valve can be configured to control commanded movement of the extension and leveling cylinders. The flow combiner/divider can be configured to hydraulically link the extension cylinder with the leveling cylinder for synchronized operation of the extension cylinder and the leveling cylinder. The first restriction orifice can be arranged in a first hydraulic flow path between a rod end of the leveling cylinder and the flow combiner/divider. The second restriction orifice can be arranged in a second hydraulic flow path between a base end of the extension cylinder and the main control valve. The first restriction orifice can be configured to restrict flow from the rod end of the leveling cylinder during extension of the leveling and extension cylinders to maintain synchronization of the leveling and extension cylinders. The second restriction orifice can be configured to restrict flow from the base end of the extension cylinder during retraction of the leveling and extension cylinders, to maintain synchronization of the leveling and extension cylinders.

In some embodiments, another hydraulic assembly for a telescoping lift arm assembly is provided. The telescoping lift arm assembly can include a main lift arm portion, a telescoping lift arm portion configured to move telescopically relative to the main lift arm portion, and an implement supported by the telescoping lift arm portion. The hydraulic assembly can include an extension cylinder, a leveling cylinder, a main control valve, a combiner divider, and a lock valve. The extension cylinder can be configured to move the telescoping lift arm portion relative to the main lift arm portion. The leveling cylinder can be configured to adjust an attitude of the implement relative to the telescoping lift arm portion. The main control valve can be configured to control commanded movement of the extension and leveling cylinders. The flow combiner/divider can be configured to hydraulically link a rod end of the extension cylinder with a rod end of the leveling cylinder for synchronized operation of the extension cylinder and the leveling cylinder. The lock valve can be arranged in a first hydraulic flow path between a rod end of the extension cylinder and the flow combiner/divider. The lock valve can be configured to move to a first configuration during the commanded movement of the extension and leveling cylinders and to a second configuration when there is no commanded movement of the extension and leveling cylinders. The first configuration of the lock valve can permit hydraulic flow between the rod ends of the extension and leveling cylinders. The second configuration of the lock valve can block hydraulic flow between the rod ends of the extension and leveling cylinders.

In some embodiments, still another hydraulic assembly for a telescoping lift arm assembly is provided. The telescoping lift arm assembly can include a main lift arm portion, a telescoping lift arm portion configured to move telescopically relative to the main lift arm portion, and an implement supported by the telescoping lift arm portion. The hydraulic assembly can include an extension cylinder, a leveling cylinder, a main control valve, a flow combiner/divider, a first restriction orifice, and a pilot-operated check valve. The extension cylinder can be configured to move the telescoping lift arm portion relative to the main lift arm portion. The leveling cylinder can be configured to adjust an attitude of the implement relative to the telescoping lift arm portion. The main control valve can be configured to control commanded movement of the extension and leveling cylinders. The flow combiner/divider can be configured to hydraulically link the extension cylinder with the leveling cylinder for synchronized operation of the extension cylinder and the leveling cylinder. The first restriction orifice can be arranged in a first hydraulic flow path between a rod end of the leveling cylinder and the flow combiner/divider. The pilot-operated check valve can be arranged in the first hydraulic flow path in parallel with the first restriction orifice. The first restriction orifice can be configured to restrict flow from a base end of the leveling cylinder upon a compression of the leveling cylinder by an external load during retraction of the extension and leveling cylinders, to maintain synchronization of the leveling and extension cylinders. The pilot-operated check valve can be configured to permit flow along the first hydraulic flow path during the commanded movement of the extension and leveling cylinders, absent the compression of the leveling cylinder by the external load.

This Summary and the Abstract are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter.

DRAWINGS

DESCRIPTION

Figure 1:
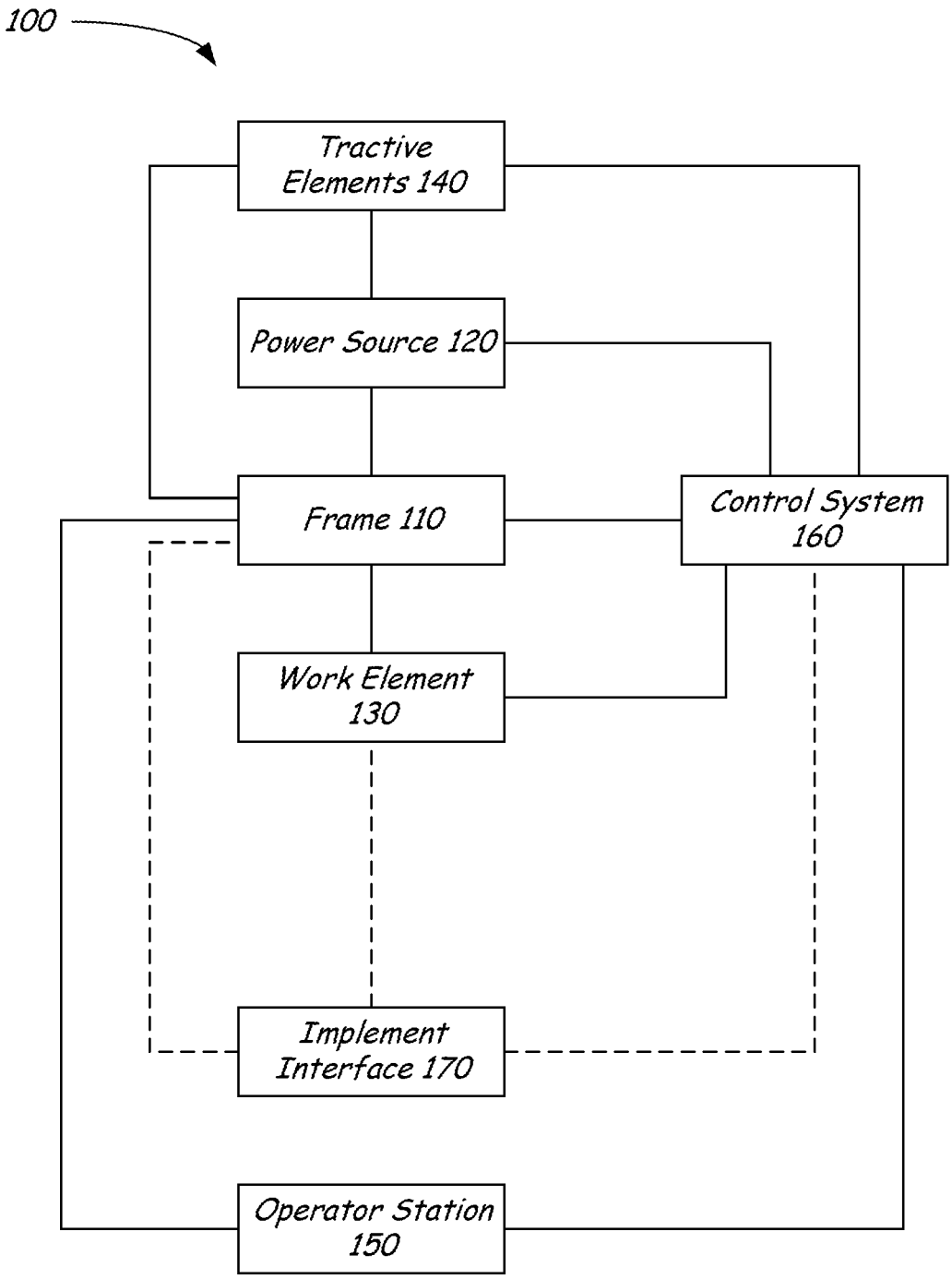
FIG. 1 is a block diagram illustrating functional systems of a representative power machine on which embodiments of the present disclosure can be advantageously practiced.

The concepts disclosed in this discussion are described and illustrated by referring to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

As used herein in the context of multiple actuators, unless otherwise defined or limited, "synchronized" refers to an orientation or a movement of the actuators that maintains a particular relative angle between the actuators. For example, synchronized hydraulic cylinders may be configured so that a particular relative angle between the extension axes of the cylinders is maintained when the cylinders are at rest, when the cylinders are actuated to extend or retract, or when the cylinders are otherwise in motion. In some cases, actuators undergoing synchronized movement may exhibit slight variations in relative angle due to power fluctuations, mechanical loading, or other factors. Actuators may still be considered to be "synchronized" provided that such variations are transient (e.g., being remedied in a relatively short time compared to the total time of the relevant synchronized extension, retraction, or other movement) or minimal (e.g., deviating from a fully synchronized relative angle by 5° or less at a distal end thereof).

For some operations, performance of power machines can be improved by maintaining synchronization between a plurality of actuators, including sets of related hydraulic cylinders. For example, some power machines can include an extendable (e.g., telescoping) lift arm with multiple hydraulic cylinders. An extension cylinder can control the extension and retraction of the lift arm, and a leveling cylinder can control the orientation of an associated structural member (e.g., a link in a multi-bar linkage that supports a tilt cylinder or an implement on the lift arm). Maintaining synchronized orientation and movement of such extension and leveling cylinders can help to reduce undesired tilting of an attached implement during extension or retraction of the lift arm such as can improve load retention or other aspects of operation of the implement. Further, appropriate synchronization of such extension and leveling cylinders can reduce the need for more active tilt control during certain power machine operations, such as might otherwise be provided by a tilt cylinder supported on the lift arm, and an associated hydraulic or electronic control architecture.

To achieve synchronized movement of hydraulic cylinders, it is generally necessary to maintain an appropriate ratio for the hydraulic flows to the cylinders. For example, for cylinders of the same size, synchronized movement can be maintained with a 1:1 flow ratio (i.e., with equal flow to each of the cylinders for any given movement). For cylinders of different sizes, however, different flow ratios may be required.

In some arrangements, synchronized actuators can be operated by a common power source or can receive operational flow from a common hydraulic circuit. For example, a set of synchronized hydraulic cylinders, including a set of extension and leveling cylinders as discussed above, can sometimes be provided with pressurized flow from a common hydraulic pump via a shared hydraulic circuit. Correspondingly, some hydraulic systems can include control devices, such as flow combiner/dividers, which can help to distribute appropriate ratios of hydraulic flow to certain cylinders within the system and can thereby help to ensure synchronized movement of those cylinders.

In some conventional arrangements, however, some power machine operations can result in sub-optimal performance of a flow combiner/divider, or other effects that can result in loss of synchronization of the cylinders. For example, when synchronized cylinders are being actuated to extend, a tension load on a first of the cylinders can cause overly rapid evacuation of hydraulic fluid from the rod end of that cylinder. Particularly if a second of the cylinders is not subjected to a similar tension load, this rapid evacuation of hydraulic fluid from the first cylinder can result in a loss of synchronization between the two cylinders and, in some cases, cavitation within the base end of the first cylinder.

As another example, a compressive load on a first cylinder of a synchronized set of cylinders, when the cylinders are being actuated to retract, can cause overly rapid evacuation of hydraulic fluid from the base end of that cylinder. Particularly if a second cylinder of the set is not subjected to a similar compressive load, this rapid evacuation of hydraulic fluid from the first cylinder can also result in a loss of synchronization between the cylinders and, in some cases, cavitation within the rod end of the first cylinder.

Additionally, some conventional flow combiner/dividers are configured to operate most effectively when there is commanded flow through the associated hydraulic system.

Correspondingly, when a hydraulic system does not have appropriate commanded flow, imbalanced loading on cylinders within the system (e.g., greater compressive loading on a first cylinder than on a second cylinder) can push flow through a flow combiner/divider so as to de-synchronize the cylinders. For example, in some configurations of a hydraulic circuit for work machines, a flow combiner/divider can be arranged to provide a hydraulic flow path between particular (e.g., rod) ends of two synchronized cylinders. Thus, the flow combiner/divider can help to ensure synchronized commanded movement of the cylinders by appropriately rationing the commanded hydraulic flow between cylinders. However, for this arrangement (and others), an imbalanced loading on the cylinders, in the absence of appropriate commanded flow through the circuit, can push flow from one cylinder to the other via the flow combiner/divider and thereby de-synchronize the cylinders.

Embodiments of the invention can address these issues, and others, by providing systems and methods for regulating hydraulic flow relative to synchronized hydraulic actuators, both during and in the absence of commanded hydraulic flow. Thus, some embodiments can result in better maintained synchronization between hydraulic cylinders, as compared to conventional systems, both during commanded movement of the cylinders and when the cylinders are stationary. Disclosed embodiments include power machines, such as small articulated loaders, and hydraulic assemblies for power machines, including power machines with lift arm assemblies and implement-leveling systems.

In some embodiments, a hydraulic circuit for a set of synchronized hydraulic cylinders can include one or more restriction orifices, which can be arranged in the hydraulic circuit to reduce flow to or from particular parts of the cylinders during particular operations or under particular loading of the cylinders. In some embodiments, a hydraulic circuit for a set of synchronized hydraulic cylinders can include one or more lock valves, which can be arranged in the hydraulic circuit to block flow to or from particular parts of the cylinders during particular operations or under particular loading of the cylinders. In some embodiments, one or more flow-blocking arrangements can be provided to selectively block or reduce flow to or from particular parts of the cylinders during particular operations or under particular loading of the cylinders. For example, some embodiments can include blocking arrangements that include a restriction orifice and a check valve arranged in parallel, or a multi-position valve that includes a one-way flow position and a restricted flow position.

Some embodiments can be particularly useful to help to maintain synchronization between hydraulic cylinders in implement-leveling systems. For example, some implement-leveling systems can include a plurality of hydraulic cylinders that are configured for synchronized interoperation, to manipulate an implement while also substantially maintaining a particular attitude for the implement. Correspondingly, some embodiments of the invention can include hydraulic assemblies that include one or more appropriately located and configured restriction orifices or other blocking arrangement and one or more lock valves that are appropriately located and configured to help to restrict or fully block flow relative to particular ends of the hydraulic cylinders during particular operating states of the relevant power machine. For example, restriction orifices can be arranged in combination with pilot-operated or other check valves to restrict flow into or out of rod or base ends of particular hydraulic cylinders when the cylinders are under tension or compression due to loading of an associated implement. This can result in more reliable synchronization of the cylinders during a variety of commanded movements. As another example, a controllable lock valve can be arranged to selectively block flow between rod (or base) ends of two cylinders when no movement of the cylinders is commanded. This can also result in more reliable synchronization of the cylinders, including during loading of the associated implement.

Figure 2:
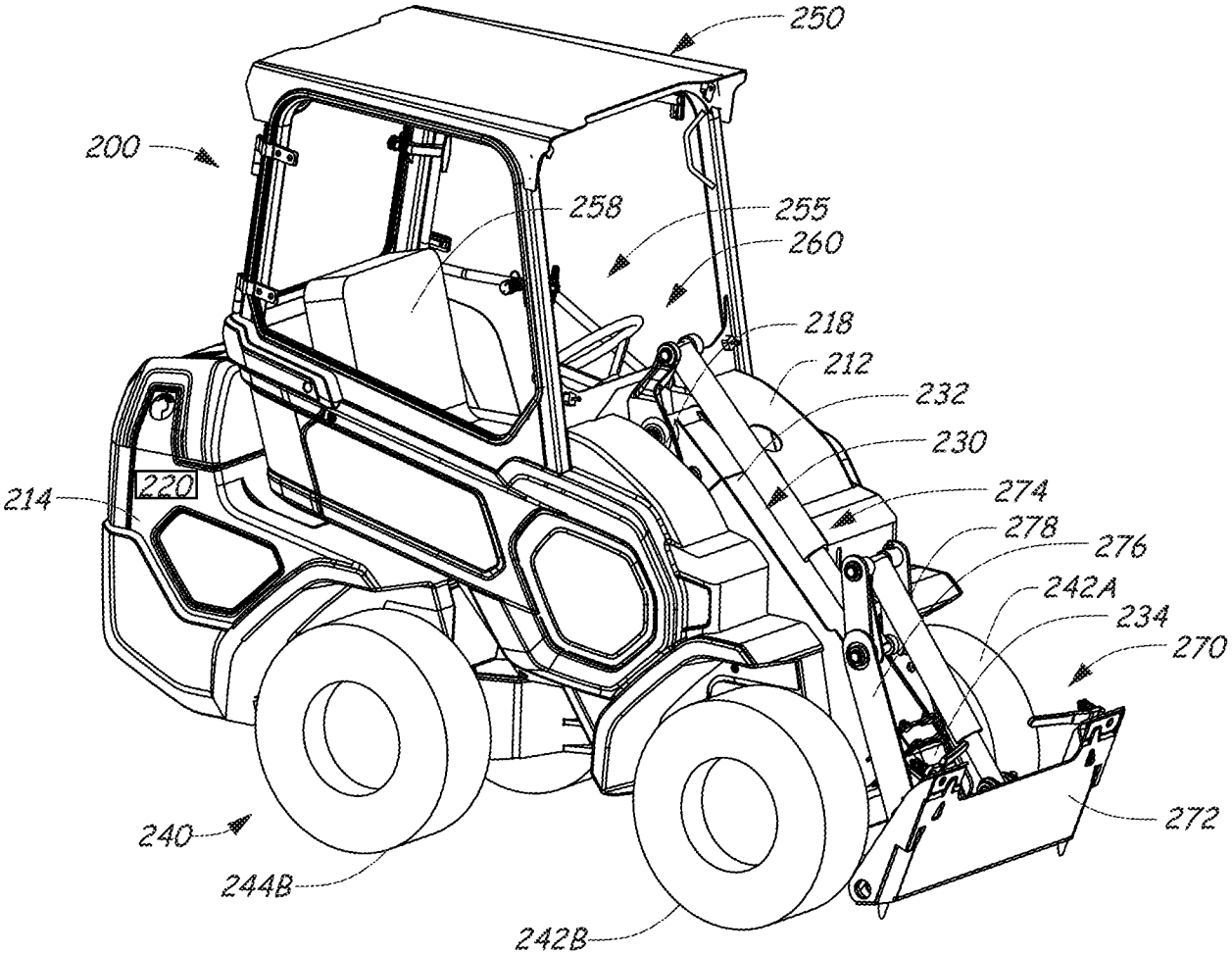
FIG. 2 is a perspective view showing generally a front of a power machine in the form of a small articulated loader on which embodiments disclosed in this specification can be advantageously practiced.
Figure 3:
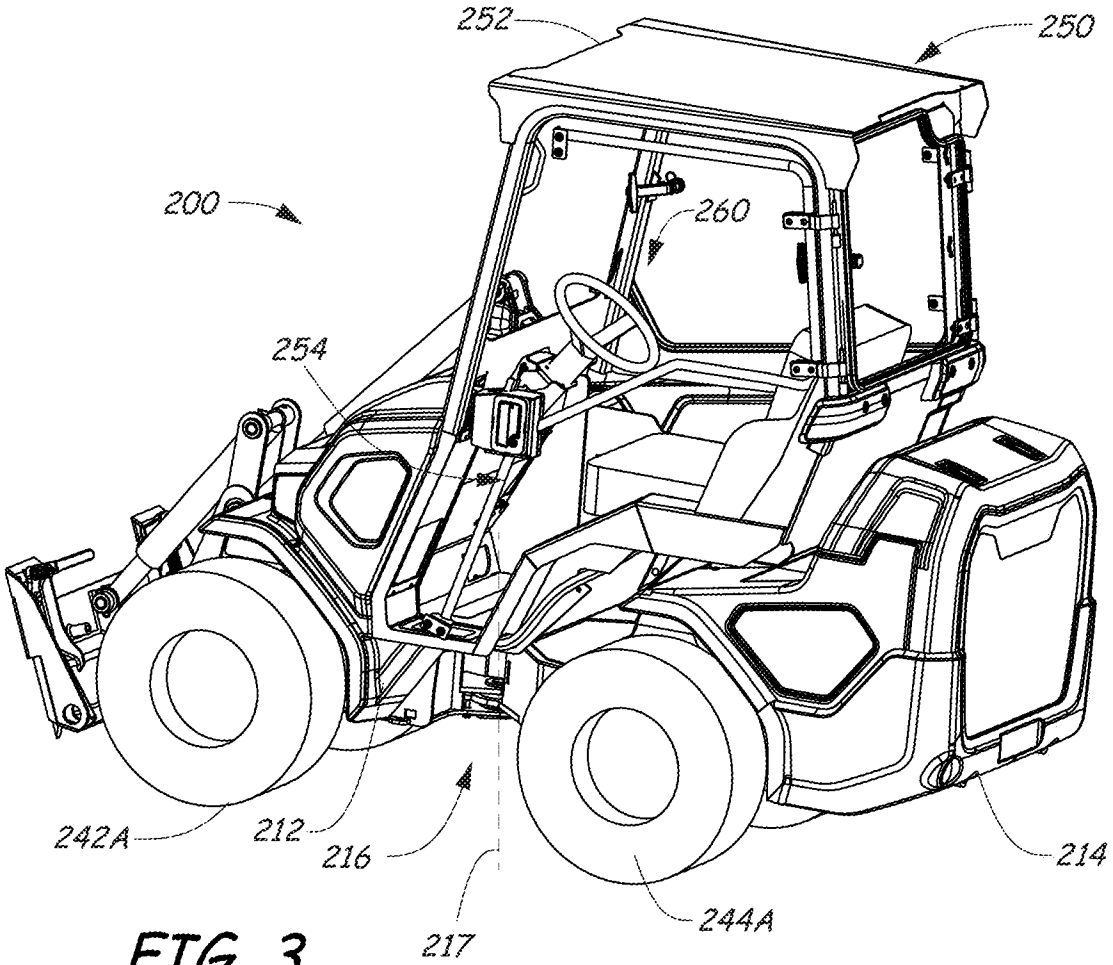
FIG. 3 is a perspective view showing generally a back of the power machine shown in FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

FIG. 1 illustrates a block diagram illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement to perform the task. In some instances, the implement can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, the implement carrier is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which can provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether they have operator compartments, operator positions or neither, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both the power machine and any implement to which is it coupled) that is capable of controlling at least some of the operator-controlled functions on the power machine.

FIGS. 2-3 illustrates a loader 200, which is one particular example of a power machine of the type illustrated in FIG. 1 where the embodiments discussed below can be advantageously employed. Loader 200 is an articulated loader with a front mounted lift arm assembly 230, which in this example is a telescopic extendable lift arm. Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. The description herein of loader 200 with references to FIGS. 2-3 provides an illustration of the environment in which the embodiments discussed below and this description should not be considered limiting especially as to the description of features that loader 200 that are not essential to the disclosed embodiments. Such features may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220 that can generate or otherwise provide power for operating various functions on the power machine. Frame 210 also supports a work element in the form of lift arm assembly 230 that is powered by the power system 220 and that can perform various work tasks. As loader 200 is a work vehicle, frame 210 also supports a traction system 240, which is also powered by power system 220 and can propel the power machine over a support surface. The lift arm assembly 230 in turn supports an implement interface 270 that includes an implement carrier 272 that can receive and secure various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices to cause the power machine to perform various work functions. Cab 250 includes a canopy 252 that provides a roof for the operator compartment and is configured to have an entry 254 on one side of the seat (in the example shown in FIG. 3, the left side) to allow for an operator to enter and exit the cab. Although cab 250 as shown does not include any windows or doors, a door or windows can be provided.

The operator station 255 includes an operator seat 258 and the various operation input devices 260, including control levers that an operator can manipulate to control various machine functions. Operator input devices can include a steering wheel, buttons, switches, levers, sliders, pedals and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 100 include control of the tractive system 240, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interact with the embodiments discussed below can have various different frame components that support various work elements. The elements of frame 210 discussed herein are provided for illustrative purposes and should not be considered to be the only type of frame that a power machine on which the embodiments can be practiced can employ. As mentioned above, loader 200 is an articulated loader and as such has two frame members that are pivotally coupled together at an articulation joint. For the purposes of this document, frame 210 refers to the entire frame of the loader. Frame 210 of loader 200 includes a front frame member 212 and a rear frame member 214. The front and rear frame members 212, 214 are coupled together at an articulation joint 216. Actuators (not shown) are provided to rotate the front and rear frame members 212, 214 relative to each other about an axis 217 to accomplish a turn.

The front frame member 212 supports and is operably coupled to the lift arm 230 at joint 216. A lift arm cylinder (not shown, positioned beneath the lift arm 230) is coupled to the front frame member 212 and the lift arm 230 and is operable to raise and lower the lift arm under power. The front frame member 212 also supports front wheels 242A and 242B. Front wheels 242A and 242B are mounted to rigid axles (the axles do not pivot with respect to the front frame member 212). The cab 250 is also supported by the front frame member 212 so that when the front frame member 212 articulates with respect to the rear frame member 214, the cab 250 moves with the front frame member 212 so that it will swing out to either side relative to the rear frame member 214, depending on which way the loader 200 is being steered.

The rear frame member 214 supports various components of the power system 220 including an internal combustion engine. In addition, one or more hydraulic pumps are coupled to the engine and supported by the rear frame member 214. The hydraulic pumps are part of a power conversion system to convert power from the engine into a form that can be used by actuators (such as cylinders and drive motors) on the loader 200. Power system 220 is discussed in more detail below. In addition, rear wheels 244A and 244B are mounted to rigid axles that are in turn mounted to the rear frame member 214. When the loader 200 is pointed in a straight direction (i.e., the front frame portion 212 is aligned with the rear frame portion 214) a portion of the cab is positioned over the rear frame portion 214.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is a radial lift arm assembly, in that the lift arm is mounted to the frame 210 at one end of the lift arm assembly and pivots about the mounting joint 216 as it is raised and lowered. The lift arm assembly 230 is also a telescoping extendable lift arm. The lift arm assembly includes a boom 232 that is pivotally mounted to the front frame member 212 at joint 216. A telescoping member 234 is slidably inserted into the boom 232 and telescoping cylinder (not shown) is coupled to the boom and the telescoping member and is operable to extend and retract the telescoping member under power. The telescoping member 234 is shown in FIGS. 2 and 3 in a fully retracted position. The implement interface 270 including implement carrier 272 and power couplers 274 are operably coupled to the telescoping member 234. An implement carrier mounting structure 276 is mounted to the telescoping member. The implement carrier 272 and the power couplers 274 are mounted to the positioning structure. A tilt cylinder 278 is pivotally mounted to both the implement carrier mounting structure 276 and the implement carrier 272 and is operable to rotate the implement carrier with respect to the implement carrier mounting structure under power. Among the operator controls 260 in the operator compartment 255 are operator controls to allow an operator to control the lift, telescoping, and tilt functions of the lift arm assembly 230.

Other lift arm assemblies can have different geometries and can be coupled to the frame of a loader in various ways to provide lift paths that differ from the radial path of lift arm assembly 230. For example, some lift paths on other loaders provide a radial lift path. Others have multiple lift arms coupled together to operate as a lift arm assembly. Still other lift arm assemblies do not have a telescoping member. Others have multiple segments. Unless specifically stated otherwise, none of the inventive concepts set forth in this discussion are limited by the type or number of lift arm assemblies that are coupled to a particular power machine.

Figure 4:
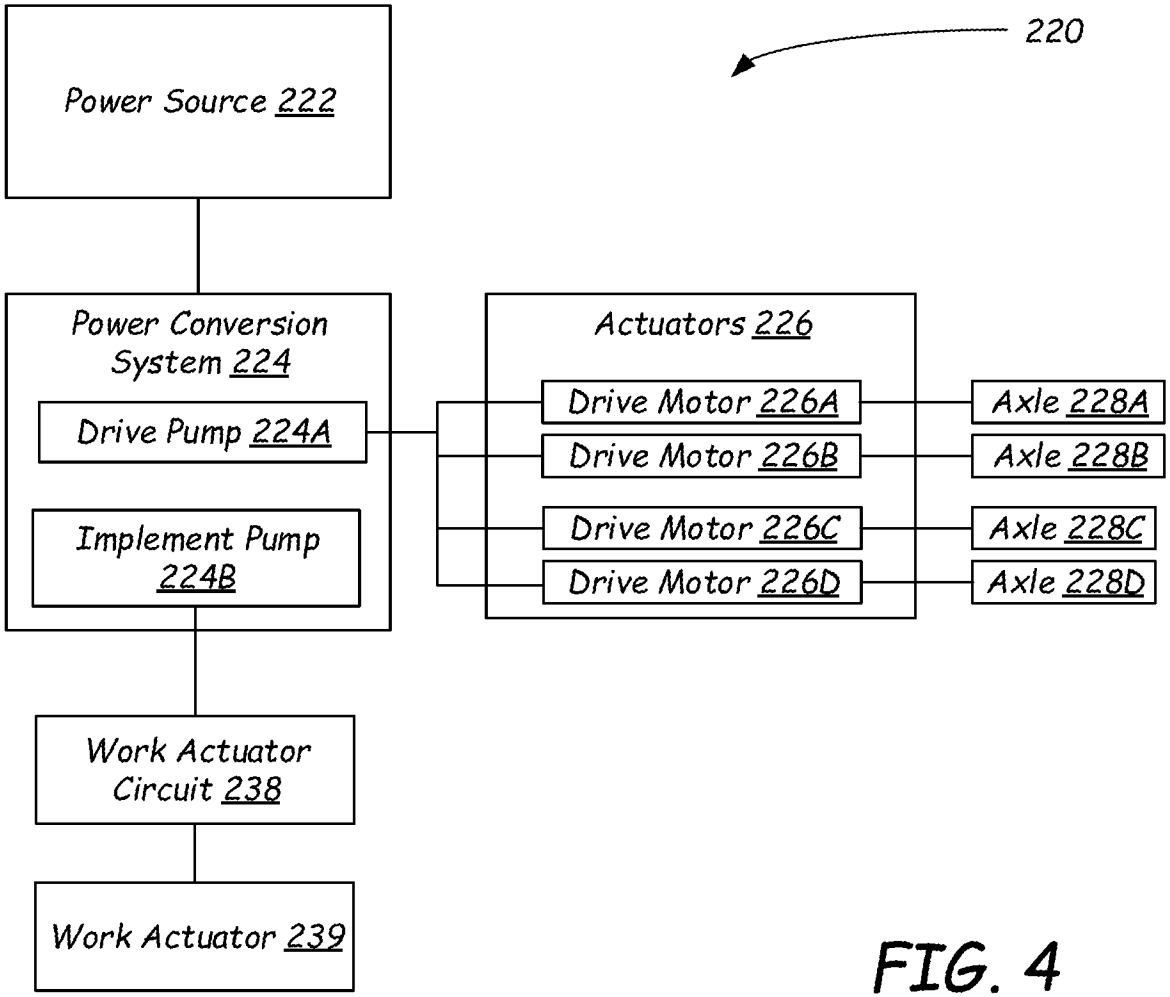
FIG. 4 is a block diagram illustrating components of a power system of a loader such as the loader of FIGS. 2 and 3.

FIG. 4 illustrates power system 220 in more detail. Broadly speaking, power system 220 includes one or more power sources 222 that can generate and/or store power for operating various machine functions. On loader 200, the power system 220 includes an internal combustion engine. Other power machines can include electric generators, rechargeable batteries, various other power sources or any combination of power sources that can provide power for given power machine components. The power system 220 also includes a power conversion system 224, which is operably coupled to the power source 222. Power conversion system 224 is, in turn, coupled to one or more actuators 226, which can perform a function on the power machine. Power conversion systems in various power machines can include various components, including mechanical transmissions, hydraulic systems, and the like. The power conversion system 224 of power machine 200 includes a hydrostatic drive pump 224A, which provides a power signal to drive motors 226A, 226B, 226C and 226D. The four drive motors 226A, 226B, 226C and 226D in turn are each operably coupled to four axles, 228A, 228B, 228C and 228D, respectively. Although not shown, the four axles are coupled to the wheels 242A, 242B, 244A, and 244B, respectively. The hydrostatic drive pump 224A can be mechanically, hydraulically, and/or electrically coupled to operator input devices to receive actuation signals for controlling the drive pump. The power conversion system also includes an implement pump 224B, which is also driven by the power source 222. The implement pump 224B is configured to provide pressurized hydraulic fluid to a work actuator circuit 238. Work actuator circuit 238 is in communication with work actuator 239. Work actuator 239 is representative of a plurality of actuators, including the lift cylinder, tilt cylinder, telescoping cylinder, and the like. The work actuator circuit 238 can include valves and other devices to selectively provide pressurized hydraulic fluid to the various work actuators represented by block 239 in FIG. 4. In addition, the work actuator circuit 238 can be configured to provide pressurized hydraulic fluid to work actuators on an attached implement.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 5:
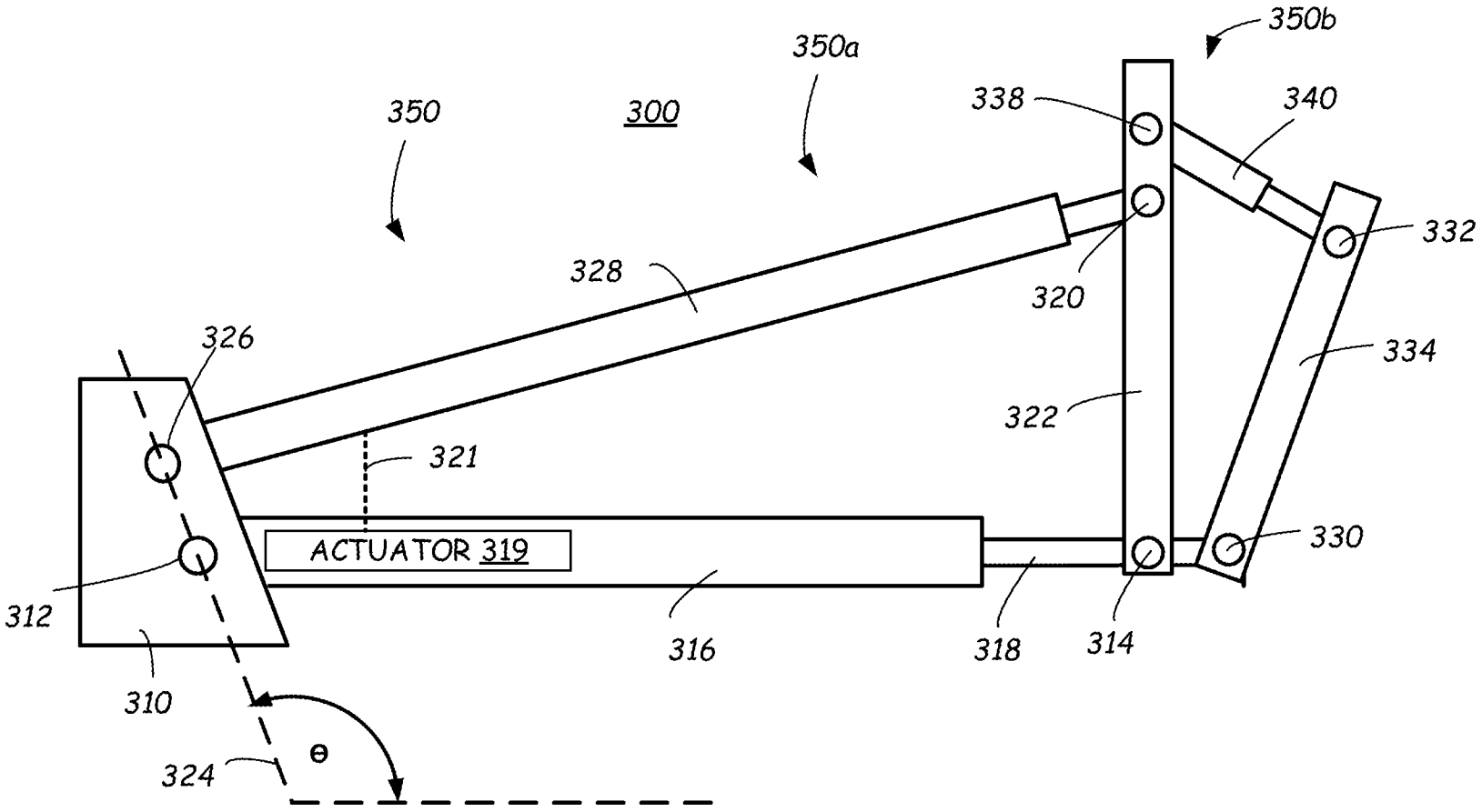
FIG. 5 is a diagrammatic illustration of a lift arm assembly having an implement-leveling system with two four-bar linkages and a telescoping lift arm, on which embodiments disclosed in this specification can be advantageously practiced.

FIG. 5 shows is a diagrammatic illustration of lift arm assembly 350 of power machine 300 on which embodiments of the disclosure can be advantageously practiced. The lift arm assembly 350 includes components to provide leveling of a bucket or other implement (not shown) that is attached to an implement carrier 334. In particular, the lift arm assembly 350 includes two four-bar linkages which together provide self-leveling operations for the bucket or other implement attached to the implement carrier 334. As part of one of the four-bar linkages, the lift arm assembly 350 includes a lift arm 316, which is a telescoping style lift arm having a telescoping portion 318 that telescopes, under power of a telescoping cylinder or actuator 319, relative to a main portion of the lift arm 316.

The lift arm assembly shown in FIG. 5 is diagrammatically provided to illustrate certain features such as the two four-bar linkages in the lift arm assembly used to provide the mechanical self-leveling aspects of disclosed embodiments. The particular geometry illustrated in FIG. 5 is not intended to reflect specific pivot point locations, orientations of components, scale of components, or other features unless otherwise stated.

In the lift arm assembly 350, the lift arm 316 is pivotally attached to a frame 310 at a pivot attachment or coupling 312. The lift arm assembly 350 has a variable length level link 328, in the form of a leveling cylinder that is pivotally attached to frame 310 at a pivot attachment or coupling 326. In example embodiments, it has been found that improved leveling performance over a range of lift arm positions is achieved with the pivot attachment 326 of leveling cylinder 328 positioned above and behind (i.e., toward an operator compartment of the power machine) the pivot attachment 312 of the lift arm 316. In some embodiments, it has been found that the pivot attachment 326 of the leveling cylinder 328 can advantageously be positioned above and rearward of the pivot attachment 312 of the lift arm such that a line of action 324 extending between pivot attachments 312 and 326 forms an angle θ, relative to a horizontal direction, of at least approximately 105°. However, this geometrical relationship is not required in all embodiments.

A leveling link 322 is also provided in each of the lift arm assemblies to facilitate the mechanical self-leveling functions. The leveling link 322, which is a fixed length link, includes three pivot attachments. First, the leveling link 322 is pivotally attached to the lift arm 316 at the pivot attachment 314. The pivot attachment 314 can be to the telescoping lift arm portion 318 in the lift arm 316. A second pivot attachment on the leveling link 322 is a pivot attachment 320 between the leveling cylinder 328 and the leveling link 322. The third pivot attachment on the leveling link 322 is a pivot attachment 338 between a tilt cylinder 340 and the leveling link 322.

As also noted above, FIG. 5 also shows the implement carrier or interface 334, which is configured to allow a bucket or other implement to be mounted on the lift arm 316. The implement carrier 334 is pivotally attached at a pivot attachment 330 to the lift arm. In the embodiment shown in FIG. 5, the pivot attachment 330 to the lift arm 316 is disposed on the telescoping portion 318. The implement carrier 334 is also pivotally attached, at a pivot attachment 332, to the tilt cylinder 340.

The leveling cylinder 328 can be, in the embodiment shown in FIG. 5, hydraulically coupled to the telescoping cylinder or actuator 319 that controls extension and retraction of the telescoping portion 318 of the lift arm 316. The hydraulic coupling is diagrammatically illustrated as the hydraulic connection 321 but can include various valves or other hydraulic components. As the lift arm telescoping actuator extends/retracts to extend/retract the telescoping portion 318, the leveling cylinder 328 also extends/retracts, in a synchronized movement. This helps to maintain the positioning of the leveling link 322 relative to the telescoping portion 318 of the lift arm 316, which can help to maintain a desired attitude of an attached implement over a variety of movements of the lift arm assembly 350.

As noted above, the lift arm assembly shown in FIG. 5 provides self-leveling using two four-bar linkages, instead of using three four-bar linkages as is common in the prior art. In the lift arm assembly shown in FIG. 5, the two four-bar linkages are designated as 350*a* and 350*b*. The first four-bar linkage 350*a* includes the frame 310, the lift arm 316 (including the telescoping portion 318), the leveling link 322 and the leveling cylinder (or other adjustable length leveling link) 328. The attachments for the first four-bar linkage include the pivot attachment 312 between the lift arm 316 and the frame 310, the pivot attachment 314 between the lift arm and the leveling link 322, the pivot attachment 320 between the leveling cylinder 328 and the leveling link 322, and the pivot attachment 326 between the leveling cylinder 328 and the frame 310.

The second four-bar linkage 350*b* includes the leveling link 322, the tilt cylinder 340, the lift arm 316 and the implement carrier 334. The pivot attachments for the second four-bar linkage include the pivot attachment 314 between the lift arm 316 and the leveling link 322, the pivot attachment 330 between the lift arm 316 and the implement carrier 334, the pivot attachment 332 between the tilt cylinder 340 and the implement carrier 334, and the pivot attachment 338 between the tilt cylinder 340 and the leveling link 322. A notable feature of the lift arm assembly discussed with reference to FIG. 5, is that the tilt cylinder 340 is pivotally coupled directly between the leveling link 322 and the implement carrier 334, instead of through additional linkages.

As also alluded to above, different configurations are possible for implement-leveling systems, including differently configured linkages and actuators than are shown in FIG. 5. Correspondingly, embodiments of the disclosure can be advantageously practiced on implement-leveling systems other than the system shown in FIG. 5.

Figure 6:
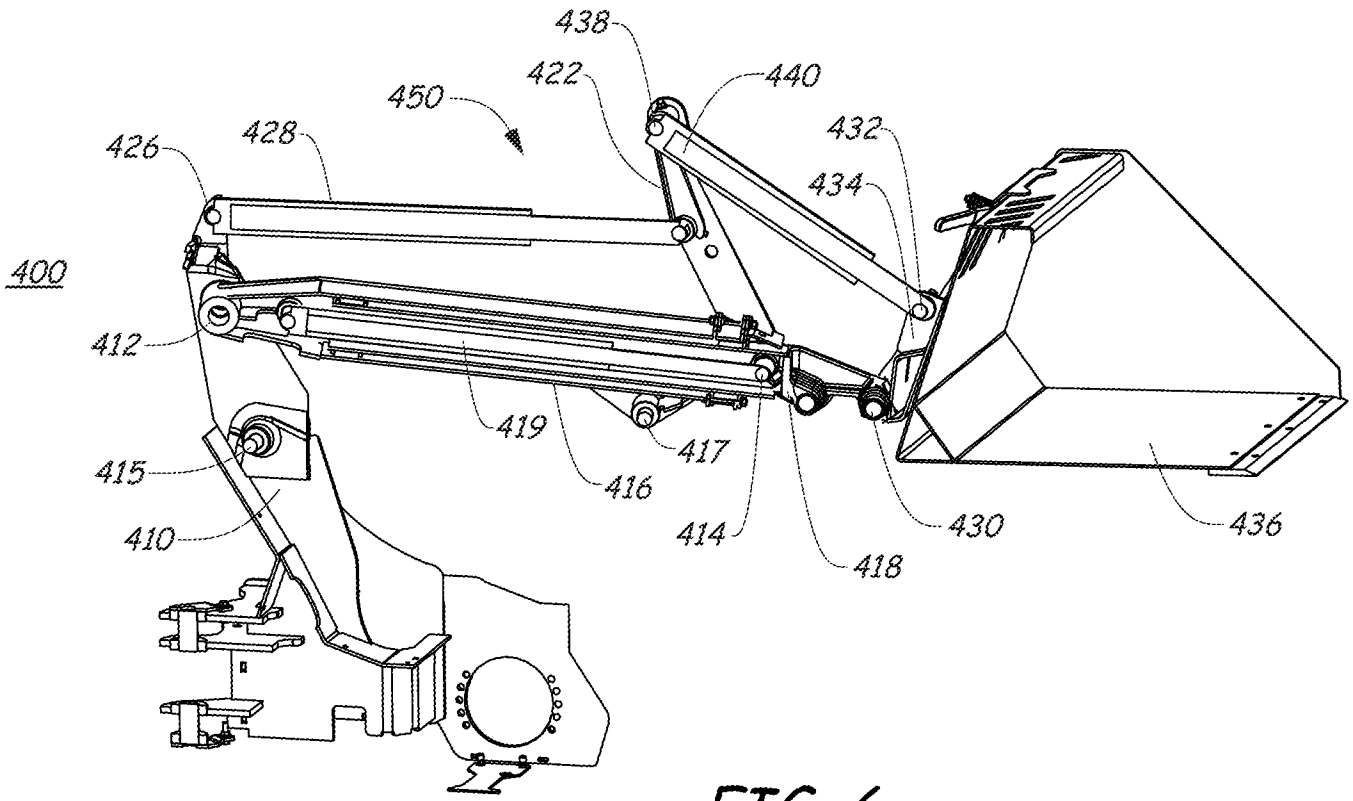
FIG. 6 is a sectional perspective view showing another lift arm assembly having an implement-leveling system with two four-bar linkages and a telescoping lift arm, on which embodiments disclosed in this specification can be advantageously practiced.

For example, FIG. 6 shows a sectional view of a telescoping lift arm assembly 450 of a power machine 400, with an implement-leveling system on which embodiments disclosed herein can be advantageously employed. Although not specifically illustrated in FIG. 6, the power machine 400 is one particular example of a power machine of the type illustrated in FIG. 1, configured similarly to the articulated loader 200 of FIG. 2, on which the embodiments disclosed herein can be advantageously employed. As shown in FIG. 6, the telescoping lift arm assembly 450 includes components similar to those discussed above with reference to FIG. 5, as may be used to provide hydraulically implemented leveling of a bucket 436 or another implement attached to an implement carrier 434 during movement of the relevant implement by the lift arm assembly 450.

In several aspects, the lift arm assembly 450 includes similar components as the lift arm assembly 350, including two four-bar linkages 450*a*, 450*b* that can be controlled by associated hydraulic cylinders to provide improved implement-leveling operations. For example, in the lift arm assembly 450, a main lift arm portion 416 is pivotally attached to a frame 410 at a pivot attachment or coupling 412. The main lift arm portion 416 is also slidably coupled to a telescoping lift arm portion 418, which extends along the outside of the main lift arm portion 416 and forward of a forward end thereof. In other embodiments, a telescoping portion of a lift arm can be otherwise configured, such as to extend within a main portion of a lift arm. An extension cylinder 419 within the main lift arm portion 416 can be selectively commanded to extend or retract, in order to extend or retract the telescoping lift arm portion 418 with respect to the lift arm 416. A variable length leveling link 428 configured as a hydraulic cylinder is also pivotally attached to frame 410 at a pivot attachment or coupling 426. The variable length leveling link 428 can be selectively commanded to extend or retract by commanding extension or retraction of a leveling cylinder 421.

A fixed length leveling link 422 is also provided to facilitate the leveling functions. Unlike leveling link 322, for example, the leveling link 422 includes pivot attachments at only two locations, although other configurations are possible. First, the leveling link 422 is pivotally attached to the telescoping lift arm portion 418 at a pivot attachment (not shown), thus helping to define the first four-bar linkage 450*a*, as formed by the main lift arm portion 416, the telescoping lift arm portion 418, the variable length leveling link 428, and the fixed length leveling link 422, i.e., with two separate variable length links. The second pivot attachment on leveling link 422 is a pivot attachment 420 between the leveling cylinder 428, the leveling link 422, and a tilt cylinder 440, thus helping to define the second four-bar linkage 450*b*, as formed by the telescoping lift arm portion 416, the tilt cylinder 440, the leveling link 422, and part of the implement carrier 434. The pivot attachment 420 can provide independent rotational coupling between the leveling cylinder 428 and both the leveling link 422 and the tilt cylinder 440, such that each of the leveling link 422 and the tilt cylinder 440 can rotate independently about the pivot attachment 420 with respect to the leveling cylinder 428.

The implement carrier or interface 434 is configured to allow the bucket 436 or other implement (not shown) to be mounted on lift arm assembly 450, including at a pivot attachment 430 to the telescoping lift arm portion 418. The implement carrier 434 is also pivotally attached, via a pivot attachment 432, to tilt cylinder 440.

To help level the bucket 436 or other implement during movement of the lift arm assembly 450, the leveling cylinder 428 can be hydraulically coupled to the extension cylinder 419 that controls extension and retraction of telescoping portion 418 of lift arm 416. Thus, as the extension cylinder 419 extends/retracts to extend/retract the telescoping lift arm portion 418 relative to the main lift arm portion 416, the leveling cylinder 428 can also simultaneously and synchronously extend/retract. Thus, through appropriate synchronization between the extension and leveling cylinders 419, 428 the leveling link 422, including the pivot attachment 420, can be moved in synchronization with the telescoping lift arm portion 416, and the attitude of the bucket 436 or another implement can be substantially maintained.

As noted above, during operation of a leveling cylinder and an extension cylinder, hydraulic communication may be maintained between the two cylinders, such as between the base ends of both cylinders and between the rod ends of both cylinders, in order to effect appropriately synchronized movement, and, for example, to maintain synchronization between the two cylinders when the cylinders are not moving. Accordingly, hydraulic circuits for leveling cylinders and extension cylinders can include hydraulic flow lines that connect the cylinders together. However, without appropriate regulation of hydraulic flow, uneven loading on the two cylinders during certain operations can sometimes result in undesired loss synchronization. Thus, for example, embodiments of the invention can include appropriately disposed and configured restriction orifices and other flow-control devices in order to selectively restrict flow between leveling and extension cylinders, including during particular operational modes for the relevant power machines.

Figure 7:
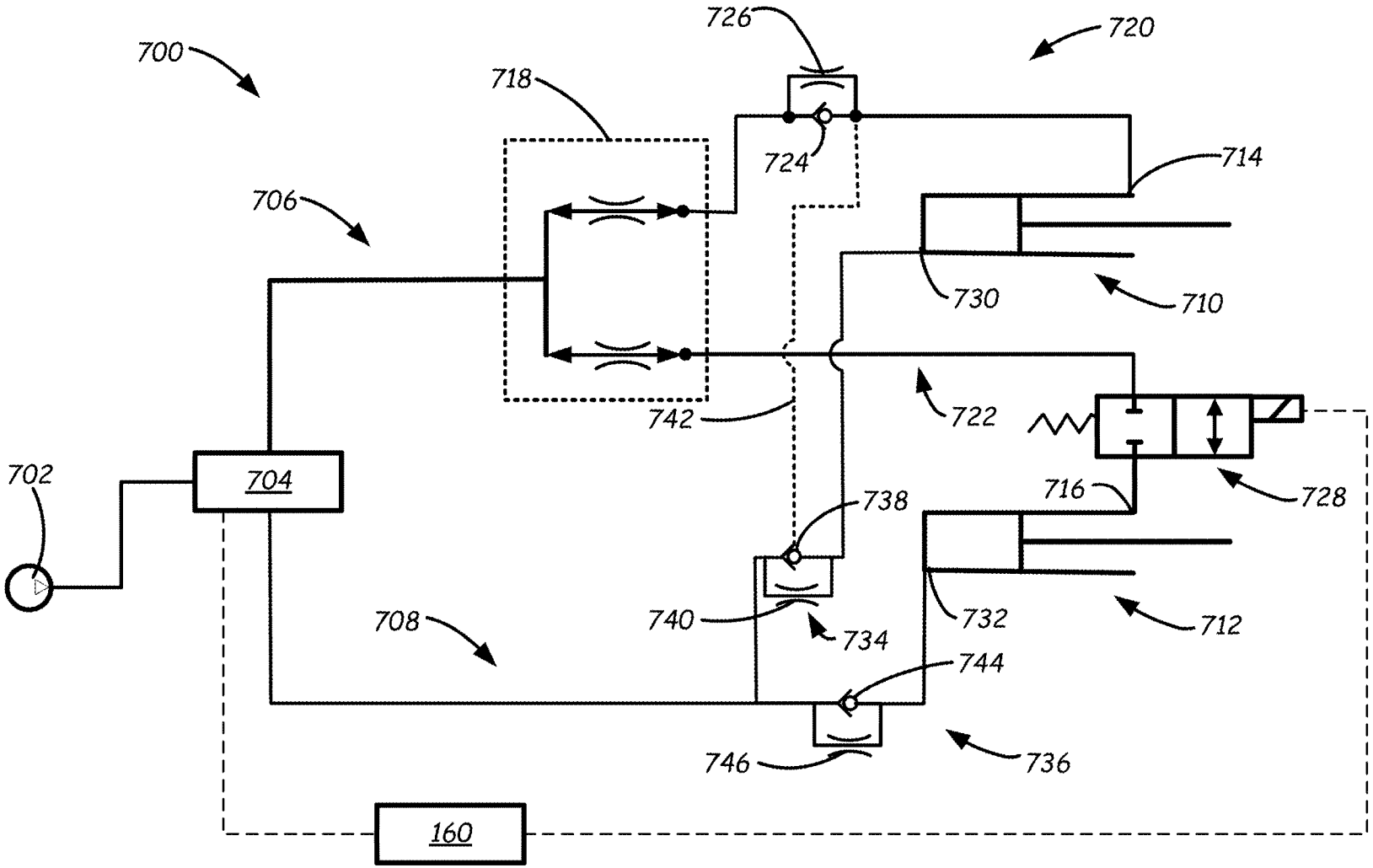
FIG. 7 is a diagrammatic illustration of a hydraulic leveling circuit according to some embodiments disclosed in this specification.

FIG. 7 shows an example hydraulic circuit 700 according to some embodiments of the disclosure, which is one particular example of a work actuator circuit of the type illustrated in FIG. 4 and which can be implemented on power machines such as the type illustrated in FIG. 1, including articulated loaders such as the type illustrated in FIG. 2. The hydraulic circuit 700 can provide appropriate control of hydraulic flow for self-leveling systems, including systems similar to those illustrated in FIGS. 5 and 6 and others. Correspondingly, in some cases, the hydraulic circuit 700 or other hydraulic circuits according to this disclosure can be used with the lift arm assemblies 350, 450 as illustrated in FIGS. 5 and 6 or other lift arm assemblies, including those having different geometries and components than the lift arm assemblies 350, 450 of FIGS. 5 and 6.

In this regard, the description herein of hydraulic circuit 700 with reference to FIG. 7 should not be considered limiting of the disclosure in general, particularly as to the description of features of hydraulic circuit 700 that are not essential to the disclosed embodiments. Such features may or may not be included in power machines other than loader 200 upon which the embodiments disclosed below may be advantageously practiced. Unless specifically noted to the contrary, embodiments disclosed herein can be practiced on a variety of power machines, with an articulated loader such as the loader 200 being only one example of those power machines. For example, some or all of the concepts discussed below can be practiced on many other types of work vehicles such as various other loaders, excavators, trenchers, and dozers, to name but a few examples.

In the hydraulic circuit 700, an implement pump 702, which can be an example of the implement pump 224B of FIG. 4, can provide pressurized hydraulic fluid to a main control valve (MCV) 704, which can be an example valve of a work actuator circuit, such as the work actuator circuit 238 of FIG. 4. The MCV 704 is in fluid communication with a first line 706 and a second line 708, such that the MCV 704 can selectively route hydraulic flow from the pump 702 to one or both of the lines 706, 708, as needed. In particular, the MCV 704 can include any number of arrangements of valves or other devices (not shown) to selectively provide pressurized hydraulic fluid to either the first line 706 or the second line 708, and thereby selectively extend or retract a leveling cylinder 710 and an extension cylinder 712. For example, the MCV 704 can be configured to selectively provide pressurized hydraulic fluid to either of the first line 706 or the second line 708 in response to an operator input signal in order to extend or retract, respectively, both of the leveling and extension cylinders 710, 712. The operator input signal can be received, for example, from an operator using various operator input devices 260 disposed within the operator station 255 of the loader 200 (see FIG. 2), from an autonomous command system, from a remote control signal, or otherwise.

As also noted above, in some implementations, the leveling cylinder 710 and the extension cylinder 712 can be utilized in a lift arm assembly similar to either of the lift arm assemblies 350, 450 (see FIGS. 5 and 6), including with the cylinders 710, 712 similarly disposed and configured as the cylinders 328, 421 and the cylinders 319, 419, respectively. In other implementations, however, the leveling and extension cylinders 710, 712 can be included in different types of lift arm assemblies, including lift arm assemblies with different components, structures, linkage geometries, or other aspects than are illustrated in FIGS. 5 and 6.

In the embodiment illustrated in FIG. 7, the first line 706 provides fluid communication between the MCV 704, a rod end 714 of leveling cylinder 710, and a rod end 716 of extension cylinder 712. Further, the first line 706 includes a flow combiner/divider 718, a leveling cylinder first line 720, and an extension cylinder first line 722. The lines 720, 722 are configured to provide flow from the MCV 704 to the rod ends 714, 716 of the cylinders 710, 712, respectively, and accordingly, to hydraulically connect the rod ends 714, 716 of the cylinders 710, 712 to each other, via the flow combiner/divider 718, for synchronized operation of the cylinders 710, 712. Further, the flow combiner/divider 718 is configured to provide a generally balanced hydraulic fluid flow, with a constant flow ratio, between the leveling cylinder 710 and the extension cylinder 712, so that the cylinders 710, 712 can operate with synchronized movement and can otherwise maintain a synchronized relationship, such as described above, for example, relative to the cylinders 419, 421 (see FIG. 6).

The flow combiner/divider 718 is illustrated with a simplified schematic in FIG. 7 and can be any type of flow combiner/divider valve, flow combiner/divider valve arrangement, or other flow combiner/divider device that is configured to provide an appropriate flow balance between the leveling cylinder 710 and the extension cylinder 712. In this regard, for example, the flow combiner/divider 718 can be generally configured to provide a constant flow ratio for commanded hydraulic flow to the cylinders 710, 712, such as may ensure that the leveling cylinder 710 and extension cylinder 712 operate in a synchronized manner, with the leveling cylinder 710 and the extension cylinder 712 having matched strokes during extension and retraction. In some cases, such for configurations which the cylinders 710, 712 are substantially similar in size, the appropriate flow ratio for such synchronized operation can be 1:1. In other cases the flow ratio can be more or less than 1:1.

In the illustrated embodiment of FIG. 7, a flow combiner/divider (i.e., the flow combiner/divider 718) is provided only along the hydraulic flow path provided by the first line 706, and not along the hydraulic flow path provided by the second line 708. Further, the flow combiner/divider 718 is configured to operate selectively as a flow combiner or as a flow divider, depending on the commanded movement of the two cylinders 710, 712. In particular, the flow combiner/divider 718 is configured to operate as a flow divider relative to the rod ends 714, 716 of the cylinders 710, 712 during commanded retraction of the cylinders 710, 712 and to operate as a flow combiner relative to the rod ends 714, 716 of the cylinders 710, 712 during commanded extension of the cylinder 710, 712.

In other embodiments, other configurations are possible, including configurations in which flow combiner/dividers are provided along two hydraulic flow paths out of a main control valve, and configurations in which such flow combiners/dividers are configured to operate only as flow dividers and not as flow combiners. For example, some embodiments can include a flow combiner/divider that is generally similar to the flow combiner/divider 718 but that is located along the second flow path 708. In such an arrangement, for example, the flow combiner/divider can be configured to divide flow to base ends 730, 732 of the cylinders 710, 712 during commanded extension of the cylinders 710, 712 and to operate as a flow divider relative to the base ends 730, 732 of the cylinders 710, 712 during commanded retraction of the cylinders 710, 712.

Generally, the hydraulic circuit in FIG. 7 is flow independent, although some operating conditions may result in variations in performance due to variations in flow rates. In some implementations, the hydraulic circuit in FIG. 7 may be more effective in maintaining cylinder synchronization for certain operations (e.g., retraction of the cylinders 710, 712) than for others (e.g., extension of the cylinders 710, 712). However, appropriate configuration of the flow combiner/divider 718, such as to allow continued movement of one of the cylinders 710, 712 when the other cylinder 712, 710 has reached end of stroke first, can help to remedy any deviation from synchronization. For example, if certain operations result in excessive misalignment of the angle of the cylinders 710, 712, simply extending or retracting both cylinders 710, 712 to the end of their respective strokes can re-synchronize the cylinders 710, 712 for continued synchronized operation thereafter.

In any case, various components of the hydraulic circuit 700, including components of the flow combiner/divider 718, may be sized or otherwise configured in various ways according to various expected operational parameters or specifications. For example, various components of the hydraulic circuit 700 may be sized or otherwise configured based on expected loads, desired hydraulic pressure drops, and other parameters for particular expected operating conditions. As such, the particular sizes and configurations of components illustrated in FIG. 7 and otherwise disclosed herein may differ in other embodiments of the disclosure.

As noted above, the leveling cylinder first line 720 provides fluid communication between the flow combiner/divider 718 and the rod end 714 of the leveling cylinder 710. In the embodiment illustrated in FIG. 7, the leveling cylinder first line 720 includes a flow-blocking arrangement configured as a first leveling check valve 724 and a first leveling restriction orifice 726 arranged in parallel with each other. The first leveling check valve 724 is arranged on the leveling cylinder first line 720 such that flow from the flow combiner/divider 718 toward the rod end 714 of leveling cylinder 710 can pass relatively uninhibited through the first leveling check valve 724, whereas flow in the reverse direction (i.e., from the rod end 714 of the leveling cylinder 710 toward the flow combiner/divider 718) is generally prevented from passing through the first leveling check valve 724. Thus, during commanded retraction of the cylinders 710, 712, the check valve 724 of the noted flow-blocking arrangement can allow generally unimpeded flow to the rod end 714 of the leveling cylinder 710, whereas the check valve 724 may generally block flow through the check valve 724 during commanded extension of the cylinders 710, 712.

Because the first leveling restriction orifice 726 is arranged in parallel with the first leveling check valve 724, although flow from the flow combiner/divider 718 toward the rod end 714 of the leveling cylinder 710 can pass relatively uninhibited through the first leveling check valve 724, flow in the reverse direction is diverted to pass through the first leveling restriction orifice 726, due to the one-way nature of the first leveling check valve 724. Accordingly, flow from the rod end 714 of leveling cylinder 710 towards the flow combiner/divider 718 is generally limited by the first leveling restriction orifice 726. Thus, during commanded extension of the cylinders 710, 712, flow from the rod end 714 of the leveling cylinder 710 may be restricted by the restriction orifice 726 of the noted flow-blocking arrangement.

To control hydraulic flow between the rod end 716 of the extension cylinder 712 and the MCV 704, the flow combiner/divider 718, and rod end 714 of the leveling cylinder 710, the extension cylinder first line 722 includes a selective lock valve 728 disposed between the flow combiner/divider 718 and the rod end 716 of the extension cylinder 712. The selective lock valve 728 is movable between an open position (not shown), in which fluid flow between flow combiner/divider 718 is permitted, and a closed position (as shown in FIG. 7), in which fluid flow between the flow combiner/divider 718 and the rod end 716 of the extension cylinder 712 is prevented. Thus, depending on the state of the lock valve 728, flow may between the rod ends 714, 716 of the cylinders 710, 712 may be permitted or may be blocked.

In some cases, the selective lock valve 728 can be configured to automatically move into the open position when the leveling cylinder 710 and the extension cylinder 712 are commanded to extend or retract, as also discussed below. Similarly, the selective lock valve 728 can be configured to automatically move into the closed position when the leveling cylinder 710 and the extension cylinder 712 are not being commanded to extend or retract, as also discussed below. The selective lock valve 728 is shown in FIG. 7 as a solenoid-operated (i.e., electrically controllable), default-off valve. However, other configurations are possible, including hydraulically operated pilot valves, or other valve types.

Opposite the MCV 704 from the first line 706, the second line 708 provides a flow path between the MCV 704, the base end 730 of the leveling cylinder 710, and the base end 732 of the extension cylinder 712. The second line 708 includes a leveling cylinder second line 734 that leads to the leveling cylinder 710, and an extension cylinder second line 736 that leads to the extension cylinder 712.

The leveling cylinder second line 734 provides fluid communication between the MCV 704 and the base end 730 of the leveling cylinder 710 and includes another flow-blocking arrangement that includes a check valve 738 and a second leveling restriction orifice 740 that are arranged in parallel with each other. In some embodiments, the check valve 738 is a spring-biased pilot-operated check valve, although other configurations are possible for the check valve and for the flow-blocking arrangement in general.

The check valve 738 is arranged on the leveling cylinder second line 734 such that flow from the MCV 704 toward the base end 730 of the leveling cylinder 710 may flow through the check valve 738 to the base end 730 of the leveling cylinder 710 during commanded extension of the cylinders 710, 712. Conversely, flow from the base end 730 of the leveling cylinder 710 toward the MCV 704 through the check valve 738 is generally prevented. Thus, as also discussed below, flow from the base end 730 of the leveling cylinder 710 during commanded retraction of the cylinders 710, 712 may generally be diverted through the restriction orifice 740. Further, because the second leveling restriction orifice 740 is arranged in parallel with the check valve 738, although flow from the MCV 704 toward the base end 730 of the leveling cylinder 710 (e.g., during commanded extension of the cylinders 710, 712) can pass generally uninhibited through the check valve 738, flow in the reverse direction (e.g., during commanded retraction of the cylinders 710, 712) is generally diverted to pass through the second leveling restriction orifice 740. Accordingly, flow from the base end 730 of leveling cylinder 710 towards the MCV 704 is generally limited by the second leveling restriction orifice 740.

In some cases, however, operation of the pilot-operated check valve 738 can result in relatively unimpeded flow through the check valve 738 from the base end 730 of the leveling cylinder 710 to the MCV 704, including during commanded retraction of the cylinders 710, 712. For example, in the illustrated configuration, the check valve 738 is operably coupled to the leveling cylinder first line 720 through a pilot line 742. As such, if the hydraulic pressure within the leveling cylinder first line 720 is sufficiently high (e.g., to overcome the biasing force of a spring element of the check valve 738), the pressurization of the pilot line 742 can open the check valve 738, thereby allowing for hydraulic fluid to flow generally unrestricted from the base end 730 of the leveling cylinder 710 to the MCV 704.

Accordingly, for example, during a commanded retraction of the cylinders 710, 712 with the leveling cylinder 710 under a tension load, pressure in the pilot line 742 may be relatively high, resulting in the check valve 738 being opened for relatively unimpeded flow of hydraulic fluid from the base end 730 of the leveling cylinder 710. In contrast, for example, during a commanded retraction of the cylinders 710, 712 with the leveling cylinder 710 under a compression load (e.g., during back dragging, as also discussed below), pressure in the pilot line 742 may be insufficient to open (or keep open) the check valve 738, thereby resulting in flow from the base end 730 of the leveling cylinder 710 being diverted through the restriction orifice 740. As also discussed below, this can help to avoid collapse of the leveling cylinder 710 during some operations.

In the illustrated example, the pilot line 742 connects to the leveling cylinder first line 720 downstream of the first leveling check valve 724 and the first leveling restriction orifice 726 (i.e., closer to leveling cylinder 710 and opposite the flow combiner/divider 718 from the MCV 704). However, in other embodiments, other configurations are possible. For example, the pilot line 742 can alternatively connect to the leveling cylinder first line 720 upstream of first leveling check valve 724 and the first leveling restriction orifice 726 (i.e., farther from leveling cylinder 710 and on an opposing side of the restriction orifice 726 than is shown).

The extension cylinder second line 736 provides fluid communication between the MCV 704 and the base end 732 of the extension cylinder 712. The extension cylinder second line 736 includes another flow-blocking arrangement that includes a second extension check valve 744 and a second extension restriction orifice 746 arranged in parallel with each other. The second extension check valve 744 is arranged on the extension cylinder second line 736 such that flow from the MCV 704 toward the base end 732 of the extension cylinder 712 is generally uninhibited by the second extension check valve 744, while flow in the reverse direction (i.e., from the base end 732 of the extension cylinder 712 toward the MCV 704) through the second extension check valve 744 is generally prevented.

Because the second extension restriction orifice 746 is arranged in parallel with the second extension check valve 744, flow from the MCV 704 toward the base end 732 of the extension cylinder 712 can pass generally uninhibited through the second extension check valve 744, whereas flow in the reverse direction is diverted through the second extension restriction orifice 746 due to the one-way nature of the second extension check valve 744. Accordingly, flow from the base end 732 of the extension cylinder 712 is generally limited by the second extension orifice 746. Thus, for example, flow from the MCV 704 to the base end 732 of the extension cylinder 712 during extension of the cylinders 710, 712 may be generally unimpeded, passing through the check valve 744. In contrast, flow from the extension cylinder 712 to the MCV 704 during commanded retraction of the cylinders 710, 712 may be diverted through the restriction orifice 746 and be restricted accordingly.

As noted above, different sizes, different relative locations, or other variations on aspects of the components of the hydraulic circuit 700 can be employed in other embodiments. For example, a particular range of absolute and relative sizes of the restriction orifices 726, 740, 746 may be appropriate for a particular configuration of the cylinders 710, 712, the MCV 704, the flow combiner/divider 718, and the pump 702, for a particular range of expected operating conditions (e.g., hydraulic pressures and pressure drops), and for a power machine such as the loaders 200, 300, 400 with lift arm assemblies similar to those described above. However, other ranges of absolute and relative sizes for these or other restriction orifices may be appropriate for other configurations and expected operating conditions, or for other power machines or lift arm assemblies.

The hydraulic circuit 700 as illustrated and described, and other hydraulic circuits according to the disclosure can be useful to help ensure synchronized operation of the cylinders 710, 712, or other cylinders, as well as to otherwise improve system performance, including in particular operating conditions. In some cases, for example, as further discussed below, the hydraulic circuit 700 and, in particular, the arrangement of the check valves 724, 738, 744 and the restriction orifices 726, 740, 746 in the example flow-blocking arrangements of FIG. 7 can be useful to help ensure synchronized movement and orientation of the leveling and extension cylinders 710, 712, including during operation of a lift arm assembly similar to the lift arm assemblies 350, 450 of FIGS. 5 and 6 (e.g., with the extension cylinder 710 as an implementation of either of the cylinders 319, 419, and with the leveling cylinder as an implementation of either of the cylinders 328, 421). In other implementations, however, the leveling and extension cylinders 710, 712 can be included in different types of lift arm assemblies, including lift arm assemblies with different components, structures, linkage geometries, or other aspects than are illustrated in FIGS. 5 and 6.

Referring again to FIG. 6, when the bucket 436 is carrying a load, the force of gravity on the load urges the bucket 436 generally downward. This can result in a torsional force on the implement carrier 434, and a corresponding uneven transfer of forces from the bucket 436 to the cylinders 419, 421, via components of the two four-bar linkages. Specifically, in the configuration illustrated in FIG. 6, when the bucket 436 is weighted by a load, a clockwise torsional force (from the perspective of FIG. 6) is imparted on the implement carrier 434, which in turn imparts a tensile force on the leveling cylinder 421 and a compressive force on the extension cylinder 419. Correspondingly, for example, loading of an implement on a lift arm assembly that includes the hydraulic circuit 700 can result in a tensile force on the leveling cylinder 710 and a compressive force on the extension cylinder 712 (see FIG. 7).

Referring again to FIG. 7, when an operator commands the cylinders 710, 712 to extend, a tensile force on the leveling cylinder 710, such as may be imparted by a loaded bucket or other implement, creates a tendency for the hydraulic fluid to be drawn relatively rapidly out of the rod end 714 of the leveling cylinder 710. This, in turn, may result in (and exacerbate) cavitation within the base end 730 of the leveling cylinder 710, and can cause the leveling cylinder 710 to extend relatively rapidly. If not appropriately checked, this relatively rapid extension of the leveling cylinder 710 can cause a loss of synchronization between the cylinders 710, 712. As a result, the attitude of the implement during the commanded extension of the cylinders 710, 712 may not be appropriately maintained, the implement may tilt forward, and material on the implement can be inadvertently rolled out.

However, because of the configuration of the flow-blocking arrangement that includes the first leveling check valve 724 and the first leveling restriction orifice 726, fluid that is drawn out of the rod end 714 of the leveling cylinder 710 during a commanded extension of the cylinders 710, 712 is diverted around the check valve 724 and through the first leveling restriction orifice 726. Accordingly, flow out of the rod end 714 of the leveling cylinder 710 during extension of the cylinders 710, 712 can be substantially restricted, particularly in comparison with the relatively unimpeded flow from the rod end 716 of the extension cylinder 712 (i.e., along the extension cylinder first line 722). Thus, with appropriate configuration of the restriction orifice 726 (and other relevant components), cavitation in the base end 730 of the leveling cylinder 710 can be avoided, and appropriately synchronized movement of the cylinders 710, 712 can be maintained. In addition, passing hydraulic fluid through the restriction orifice 726 can aid in the combining performance of the combiner/divider valve 718, because it can provide pressure to appropriately balance the combiner/divider valve.

Meanwhile, still considering a commanded extension of the cylinders 710, 712, the configuration of the check valve 738 and the second extension check valve 744 allows hydraulic fluid to flow relatively freely into the base ends 730, 732 of the cylinders 710, 712 to affect the desired synchronized extension of the cylinders 710, 712. Further, as alluded to above, when the operator commands the cylinders 710, 712 to extend or retract, the lock valve 728 is configured to be moved (e.g., automatically moved) to the open position, such that hydraulic fluid can move freely out of the rod end 716 of extension cylinder 712.

Similar considerations can also apply when an implement is loaded and the operator commands the cylinders 710, 712 to retract. In this case, for example, the compressive force imparted on the extension cylinder 712 by the force of gravity on the loaded implement creates a tendency for the hydraulic fluid to be drawn relatively rapidly out of the base end 732 of the extension cylinder 712. This, in turn, may result in (and exacerbate) cavitation within the rod end 716 of the extension cylinder 712, and can cause the extension cylinder 712 to compress relatively rapidly. If not appropriately checked, this relatively rapid compression of the extension cylinder 712 can also cause a loss of synchronization between the cylinders 710, 712. As a result, the attitude of the implement during the commanded retraction of the cylinders 710, 712 may not be appropriately maintained, the implement may tilt forward, and material on the implement can be inadvertently rolled out.

However, because of the configuration of the second extension check valve 744 and the second extension restriction orifice 746, fluid that is drawn out of the base end 732 of the extension cylinder 712 during a commanded retraction of the cylinder 710, 712 is diverted around the check valve 744 and through second extension orifice 746. Accordingly, flow out of the base end 732 of the extension cylinder 712 can be substantially restricted, particularly in comparison with relatively unimpeded flow from the base end 730 of the leveling cylinder 710, due to activation of the check valve 738 via the pilot line 742 (as also discussed below). Thus, with appropriate configuration of the restriction orifice 746 (and other relevant components, such as the pilot-operated check valve 738), cavitation in the rod end 716 of the extension cylinder 712 can be avoided, and appropriately synchronized movement of the cylinders 710, 712 can be maintained. In addition, passing hydraulic fluid through the restriction orifice 726 can aid in the dividing performance of the combiner/divider valve 718, because it can provide pressure to appropriately balance the combiner/divider valve.

Meanwhile, still considering a commanded retraction of the cylinders 710, 712, the configuration of the first leveling check valve 724 and the lock valve 728 allows hydraulic fluid to flow freely into the rod ends 714, 716 of the cylinders 710, 712. As noted above, the lock valve 728 can be controlled to open when movement (e.g., retraction) of the cylinders 710, 712 is commanded, thus allowing hydraulic fluid to flow freely into or out of the rod end 716 of the cylinder 712. Further, the tensile force maintained on the leveling cylinder 710 (e.g., by the bucket 436), in combination with pressurization resulting from the commanded retraction, will generally maintain a relatively elevated pressure of the hydraulic fluid in the leveling cylinder first line 720. Because the pilot line 742 is in fluid communication with the leveling cylinder first line 720, this relatively elevated pressure can cause the check valve 738 to remain open, as also noted above. As such, hydraulic fluid can also flow relatively freely out of the base end 730 of leveling cylinder 710 to the MCV 704, bypassing the restriction orifice 740 to flow through the open check valve 738, and synchronization of the cylinders 710, 712 can be maintained.

In some embodiments, synchronization can also be maintained during other commanded movements. For example, in some cases, it can be desirable to perform a function commonly known as "back dragging" in which an implement (e.g., bucket) edge engages the ground as the power machine moves backward, thereby allowing the implement to smooth (or otherwise condition) the ground or other surface. With a telescopic loader, the backward movement of the implement (e.g., the bucket 436) for a back dragging operation can be accomplished using a telescopic function of a lift arm assembly (e.g., as opposed to using a travel function of a power machine as a whole). For some lift arm assemblies, however, back dragging operations can also result in imbalanced loading of leveling and extension cylinders. Referring again to FIG. 6, for example, when the bucket 436 is back dragged, the bucket 436 will be subject to a counterclockwise torsional force (from the perspective of FIG. 6), generally opposite to the torsional force discussed above that results from loading of the bucket 436 against gravity. Correspondingly, back dragging using the bucket 436 can result in a compression force on the leveling cylinder 421 and a tensile force on the extension cylinder 419.

Referring again to FIG. 7, similar back dragging operations can be executed with an implement secured to the leveling and extension cylinders 710, 712, such as by commanding a retraction of the cylinders 710, 712 with the implement engaged with the ground. However, due to the forces similar to those discussed for back dragging with the bucket 436 (see FIG. 6), the leveling cylinder 710 can become loaded in compression during the commanded retraction operation. And, for similar reasons as discussed above, this can tend to cause cavitation in the rod end 714 of the leveling cylinder 710, relatively rapid flow of hydraulic fluid out of the base end 730 of the leveling cylinder 710, and the resulting loss of the desired synchronization of the leveling and extension cylinders 710, 712.

However, because the leveling cylinder 710 is being compressively loaded by the implement, pressure within the leveling cylinder first line 720 correspondingly drops, despite pressurized flow into the leveling cylinder first line 720 from the MCV 704 via the flow combiner/divider 718. As such, with sufficient compressive loading of the leveling cylinder 710 (e.g., as may be sufficient to substantially increase the risk of cavitation), the pressure within the pilot line 742 will be reduced until it is no longer sufficiently high to maintain the check valve 738 in an open state. With the check valve 738 thus closed, fluid flowing out of the base end 730 of the leveling cylinder 710 toward the MCV 704 is diverted around the check valve 738 to pass through the second leveling restriction orifice 740. Accordingly, flow out of the base end 730 of the leveling cylinder 710 can be substantially restricted, with corresponding reduction of the risk of cavitation in the leveling cylinder 710. Thus, with appropriate configuration of the restriction orifice 740 (and other relevant components, such as the check valve 738), cavitation in the rod end 714 of the leveling cylinder 710 can be avoided, and appropriately synchronized movement of the cylinders 710, 712 can be maintained.

Appropriate control may also be needed to maintain a synchronized orientation of leveling and extension cylinders when no movement of the cylinders is commanded. For example, when no movement is being commanded for the cylinders 710, 712 (i.e., when there is no commanded fluid flow in the hydraulic circuit 700), various external forces can act on the cylinders 710, 712. These forces can push flow through the flow combiner/divider 718, which may tend to function best only during commanded hydraulic flow, and can thereby urge the cylinders 710, 712 out of a desired synchronized orientation.

To prevent loss of synchronization of a set of cylinders, as also alluded to above, a lock valve can be provided in order to prevent certain hydraulic flows when no movement of the cylinders is commanded. For example, the lock valve 728 in the hydraulic circuit 700 is configured to selectively block the flow path between the rod end 716 of the extension cylinder 712 and the rod end 714 of the leveling cylinder 710. Accordingly, the lock valve 728 can prevent flow between the rod ends 714, 716 of the two cylinders 710, 712, via a connection in the flow combiner/divider 718 and can thereby help to maintain the synchronized orientation of the cylinders 710, 712 when flow is not commanded. Further, as noted above, the solenoid of the lock valve 728 can be configured to be energized whenever flow is commanded for the hydraulic circuit 700 (i.e., whenever movement of the cylinders 710, 712 is commanded) in order to move the lock valve 728 to the open position and thereby permit flow between the rod ends 714, 716 of the cylinders 710, 712. Also as noted above, although the lock valve solenoid 728 is illustrated as an electrically controlled valve, other configurations are possible, including lock valves that are configured to be controlled via pilot pressure to unlock (i.e., to permit flow) when movement of the relevant cylinders is commanded.

As also noted above, particular sizes and other aspects of the restriction orifices 726, 740, 746 can be selected in order to appropriately accommodate expected flow rates, pressure drops, loading, and other relevant aspects of particular systems and particular operations. Similarly, other components, such as the check valves 724, 738, 744, the pump 702, the MCV 704, the flow combiner/divider 718, or other orifices, valves, check valves, pumps, cylinders, and so on can also be customized as appropriate for particular power machines or operating conditions.

Figure 8:
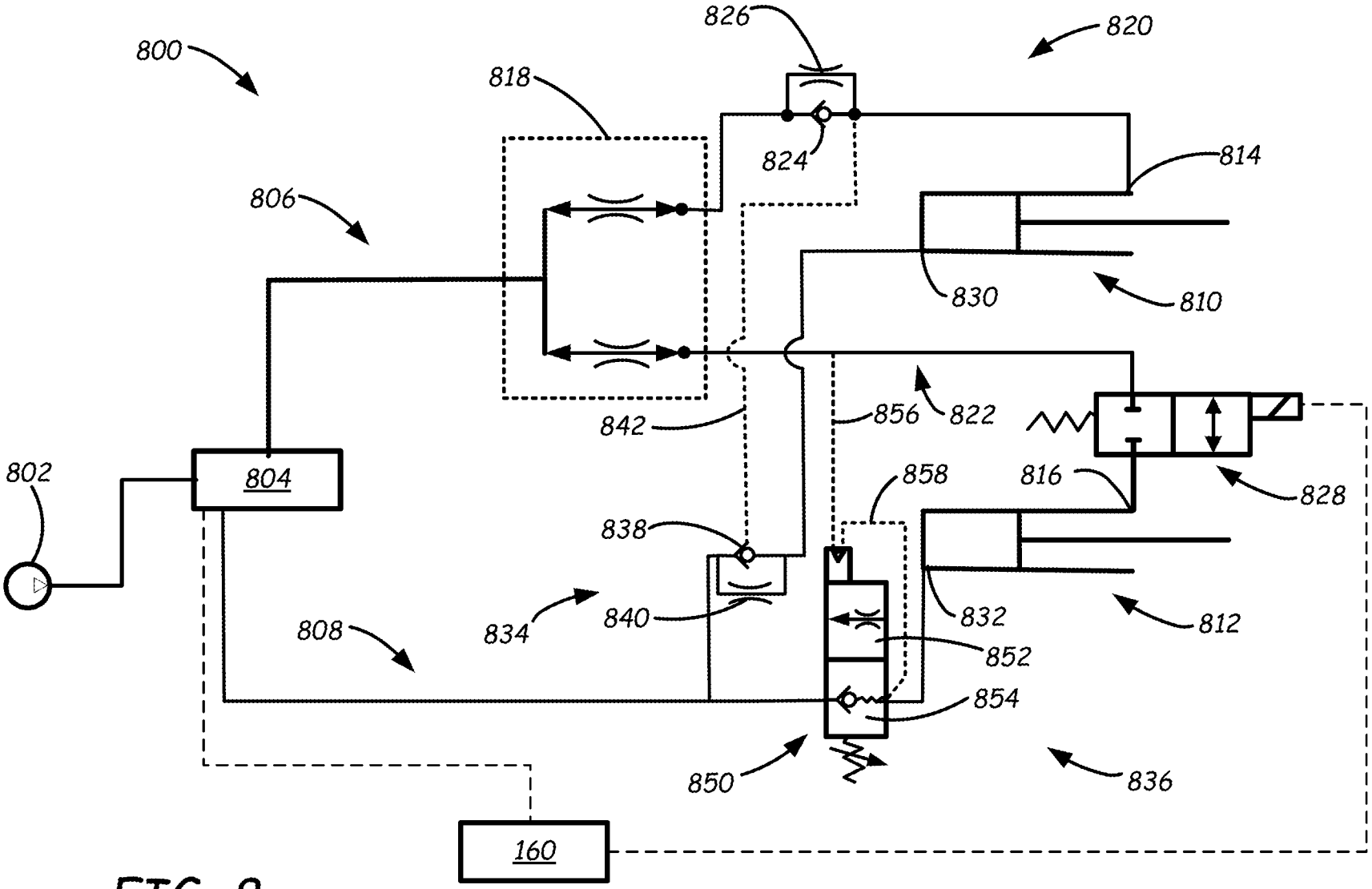
FIG. 8 is a diagrammatic illustration of a hydraulic leveling circuit according to some embodiments disclosed in this specification.

FIG. 8 shows an example hydraulic circuit 800 according to some embodiments of the disclosure, which is one particular example of a work actuator circuit of the type illustrated in FIG. 4 and which can be implemented on power machines such as the type illustrated in FIG. 1, including articulated loaders such as the type illustrated in FIG. 2. Similarly to the hydraulic circuit 700 in many ways, the hydraulic circuit 700 can provide appropriate control of hydraulic flow for self-leveling systems, including systems similar to those illustrated in FIGS. 5 and 6 and others. Correspondingly, in some cases, the hydraulic circuit 800 or other hydraulic circuits according to this disclosure can be used with the lift arm assemblies 350, 450 as illustrated in FIGS. 5 and 6 or other lift arm assemblies, including those having different geometries and components than the lift arm assemblies 350, 450 of FIGS. 5 and 6.

In this regard, the description herein of hydraulic circuit 800 with reference to FIG. 7 should not be considered limiting of the disclosure in general, particularly as to the description of features of hydraulic circuit 800 that are not essential to the disclosed embodiments. Such features may or may not be included in power machines other than loader 200 upon which the embodiments disclosed below may be advantageously practiced. Unless specifically noted to the contrary, embodiments disclosed herein can be practiced on a variety of power machines, with an articulated loader such as the loader 200 being only one example of those power machines. For example, some or all of the concepts discussed below can be practiced on many other types of work vehicles such as various other loaders, excavators, trenchers, and dozers, to name but a few examples.

In the hydraulic circuit 800, an implement pump 802, which can be an example of the implement pump 224B of FIG. 4, can provide pressurized hydraulic fluid to a main control valve (MCV) 804, which can be an example valve of a work actuator circuit, such as the work actuator circuit 238 of FIG. 4. The MCV 804 is in fluid communication with a first line 806 and a second line 808, such that the MCV 804 can selectively route hydraulic flow from the pump 802 to one or both of the lines 806, 808, as needed. In particular, the MCV 804 can include any number of arrangements of valves or other devices (not shown) to selectively provide pressurized hydraulic fluid to either the first line 806 or the second line 808, and thereby selectively extend or retract a leveling cylinder 810 and an extension cylinder 812. For example, similarly to the MCV 704, the MCV 804 can be configured to selectively provide pressurized hydraulic fluid to either of the first line 806 or the second line 808 in response to an operator input signal in order to extend or retract, respectively, both of the leveling and extension cylinders 810, 812. The operator input signal can be received, for example, from an operator using various operator input devices 260 disposed within the operator station 255 of the loader 200 (see FIG. 2), from an autonomous command system, from a remote-control signal, or otherwise.

As also noted above, in some implementations, the leveling cylinder 810 and the extension cylinder 812 can be utilized in a lift arm assembly similar to either of the lift arm assemblies 350, 450 (see FIGS. 5 and 6), including with the cylinders 810, 812 similarly disposed and configured as the cylinders 328, 421 and the cylinders 319, 419, respectively. In other implementations, however, the leveling and extension cylinders 810, 812 can be included in different types of lift arm assemblies, including lift arm assemblies with different components, structures, linkage geometries, or other aspects than are illustrated in FIGS. 5 and 6.

In the embodiment illustrated in FIG. 8, the first line 806 provides fluid communication between the MCV 804, a rod end 814 of leveling cylinder 810, and a rod end 816 of extension cylinder 812. Further, the first line 806 includes a flow combiner/divider 818, a leveling cylinder first line 820, and an extension cylinder first line 822. The lines 820, 822 are configured to provide flow from the MCV 804 to the rod ends 814, 816 of the cylinders 810, 812, respectively, and accordingly, to hydraulically connect the rod ends 814, 815 of the cylinders 810, 812 to each other, via the flow combiner/divider 818, for synchronized operation of the cylinders 810, 812. Further, the flow combiner/divider 818 is configured to provide a generally balanced hydraulic fluid flow, with a constant flow ratio, between the leveling cylinder 810 and the extension cylinder 812, so that the cylinders 810, 812 can operate with synchronized movement and can otherwise maintain a synchronized relationship, such as described above, for example, relative to the cylinders 419, 421 (see FIG. 6).

The flow combiner/divider 818 is illustrated with a simplified schematic in FIG. 8 and can be any type of flow combiner/divider valve, flow combiner/divider valve arrangement, or other flow combiner/divider device that is configured to provide an appropriate flow balance between the leveling cylinder 810 and the extension cylinder 812. In this regard, for example, the flow combiner/divider 818 can be generally configured to provide a constant flow ratio for commanded hydraulic flow to the cylinders 810, 812, such as may ensure that the leveling cylinder 810 and extension cylinder 812 operate in a synchronized manner, with the leveling cylinder 810 and the extension cylinder 812 having matched strokes during extension and retraction. In some cases, such for configurations which the cylinders 810, 812 are substantially similar in size, the appropriate flow ratio for such synchronized operation can be 1:1. In other cases the flow ratio can be more or less than 1:1.

In the illustrated embodiment of FIG. 8, a flow combiner/divider (i.e., the flow combiner/divider 818) is provided only along the hydraulic flow path provided by the first line 806, and not along the hydraulic flow path provided by the second line 808. Further, the combiner/divider 818 is configured to operate selectively as a flow combiner or as a flow divider, depending on the commanded movement of the two cylinders. In particular, the flow combiner/divider 818 is configured to operate as a flow divider relative to the rod ends 814, 816 of the cylinders 810, 812 during commanded retraction of the cylinders 810, 812 and to operate as a flow combiner relative to the rod ends 814, 816 of the cylinders 810, 812 during commanded extension of the cylinder 810, 812.

In other embodiments, other configurations are possible, including configurations in which flow combiner/dividers are provided along two hydraulic flow paths out of a main control valve, and configurations in which such flow combiners/dividers are configured to operate only as flow dividers and not as flow combiners. For example, some embodiments can include a flow combiner/divider that is generally similar to the flow combiner/divider 818 but that is located along the second flow path 808. In such an arrangement, for example, the flow combiner/divider can be configured to divide flow to base ends 830, 832 of the cylinders 810, 812 during commanded extension of the cylinders 810, 812 and to operate as a flow divider relative to the base ends 830, 832 of the cylinders 810, 812 during commanded retraction of the cylinders 810, 812.

Generally, the hydraulic circuit in FIG. 8 is flow independent, although some operating conditions may result in variations in performance due to variations in flow rates. In some implementations, the hydraulic circuit in FIG. 8 may be more effective in maintaining cylinder synchronization for certain operations (e.g., retraction of the cylinders 810, 812) than for others (e.g., extension of the cylinders 810, 812). However, appropriate configuration of the flow combiner/divider 818, such as to allow continued movement of one of the cylinders 810, 812 when the other cylinder 812, 810 has reached end of stroke first, can help to remedy any deviation from synchronization. For example, if certain operations result in excessive misalignment of the angle of the cylinders 810, 812, simply extending or retracting both cylinders 810, 812 to the end of their respective strokes can re-synchronize the cylinders 810, 812 for continued synchronized operation thereafter.

In any case, various components of the hydraulic circuit 800, including components of the flow combiner/divider 818, may be sized or otherwise configured in various ways according to various expected operational parameters or specifications. For example, various components of the hydraulic circuit 800 may be sized or otherwise configured based on expected loads, desired hydraulic pressure drops, and other parameters for particular expected operating conditions. As such, the particular sizes and configurations of components illustrated in FIG. 8 and otherwise disclosed herein may differ in other embodiments of the disclosure.

As noted above, the leveling cylinder first line 820 provides fluid communication between the flow combiner/divider 818 and the rod end 814 of the leveling cylinder 810. In the embodiment illustrated in FIG. 8, the leveling cylinder first line 820 includes a first leveling check valve 824 and a first leveling restriction orifice 826 arranged in parallel with each other. The first leveling check valve 824 is arranged on the leveling cylinder first line 820 such that flow from the flow combiner/divider 818 toward the rod end 814 of leveling cylinder 810 can pass relatively uninhibited through the first leveling check valve 824, whereas flow in the reverse direction (i.e., from the rod end 814 of the leveling cylinder 810 toward the flow combiner/divider 818) is generally prevented from passing through the first leveling check valve 824. Thus, during commanded retraction of the cylinders 810, 812, the check valve 824 of the noted flow-blocking arrangement can allow generally unimpeded flow to the rod end 814 of the leveling cylinder 810, whereas the check valve 824 may generally block flow through the check valve 824 during commanded extension of the cylinders 810, 812.

Because the first leveling restriction orifice 826 is arranged in parallel with the first leveling check valve 824, although flow from the flow combiner/divider 818 toward the rod end 814 of the leveling cylinder 810 can pass relatively uninhibited through the first leveling check valve 824, flow in the reverse direction is diverted to pass through the first leveling restriction orifice 826, due to the one-way nature of the first leveling check valve 824. Accordingly, flow from the rod end 814 of leveling cylinder 810 towards the flow combiner/divider 818 is generally limited by the first leveling restriction orifice 826. Thus, during commanded extension of the cylinders 710, 812, flow from the rod end 814 of the leveling cylinder 810 may be restricted by the restriction orifice 826 of the noted flow-blocking arrangement.

To control hydraulic flow between the rod end 816 of the extension cylinder 812 and the MCV 804, the flow combiner/divider 818, and rod end 814 of the leveling cylinder 810, the extension cylinder first line 822 includes a selective lock valve 828 disposed between the flow combiner/divider 818 and the rod end 816 of the extension cylinder 812. The selective lock valve 828 is movable between an open position (not shown), in which fluid flow between flow combiner/divider 818 is permitted, and a closed position (as shown in FIG. 8), in which fluid flow between the flow combiner/divider 818 and the rod end 816 of the extension cylinder 812 is prevented. Thus, depending on the state of the lock valve 828, flow may between the rod ends 814, 816 of the cylinders 810, 812 may be permitted or may be blocked.

In some cases, the selective lock valve 828 can be configured to automatically move into the open position when the leveling cylinder 810 and the extension cylinder 812 are commanded to extend or retract, as also discussed below. Similarly, the selective lock valve 828 can be configured to automatically move into the closed position when the leveling cylinder 810 and the extension cylinder 812 are not being commanded to extend or retract, as also discussed below. The selective lock valve 828 is shown in FIG. 8 as a solenoid-operated (i.e., electrically controllable), default-off valve. However, other configurations are possible, including hydraulically operated pilot valves, or other valve types.

Opposite the MCV 804 from the first line 806, the second line 808 provides a flow path between the MCV 804, the base end 830 of the leveling cylinder 810, and the base end 832 of the extension cylinder 812. The second line 808 includes a leveling cylinder second line 834 that leads to the leveling cylinder 810, and an extension cylinder second line 836 that leads to the extension cylinder 812.

The leveling cylinder second line 834 provides fluid communication between the MCV 804 and the base end 830 of the leveling cylinder 810 and includes another flow-blocking arrangement that includes a check valve 838 and a second leveling restriction orifice 840 that are arranged in parallel with each other. In some embodiments, the check valve 838 is a spring-biased pilot-operated check valve, although other configurations are possible for the check valve and for the flow-blocking arrangement in general.

The check valve 838 is arranged on the leveling cylinder second line 834 such that flow from the MCV 804 toward the base end 830 of the leveling cylinder 810 may flow through the check valve 838 to the base end 830 of the leveling cylinder 810 during commanded extension of the cylinders 810, 812. Conversely, flow from the base end 830 of the leveling cylinder 810 toward the MCV 804 through the check valve 838 is generally prevented. Thus, as also discussed below, flow from the base end 830 of the leveling cylinder 810 during commanded retraction of the cylinders 810, 812 may generally be diverted through the restriction orifice 840. Further, because the second leveling restriction orifice 840 is arranged in parallel with the check valve 838, although flow from the MCV 804 toward the base end 830 of the leveling cylinder 810 (e.g., during commanded extension of the cylinders 810, 812) can pass generally uninhibited through the check valve 838, flow in the reverse direction (e.g., during commanded retraction of the cylinders 810, 812) is generally diverted to pass through the second leveling restriction orifice 840. Accordingly, flow from the base end 830 of leveling cylinder 810 towards the MCV 804 is generally limited by the second leveling restriction orifice 840.

In some cases, however, operation of the pilot-operated check valve 838 can result in relatively unimpeded flow through the check valve 838 from the base end 830 of the leveling cylinder 810 to the MCV 804, including during commanded retraction of the cylinders 810, 812. For example, in the illustrated configuration, the check valve 838 is operably coupled to the leveling cylinder first line 820 through a pilot line 842. As such, if the hydraulic pressure within the leveling cylinder first line 820 is sufficiently high (e.g., to overcome the biasing force of a spring element of the check valve 838), the pressurization of the pilot line 842 can open the check valve 838, thereby allowing for hydraulic fluid to flow generally unrestricted from the base end 830 of the leveling cylinder 810 to the MCV 804.

Accordingly, for example, during a commanded retraction of the cylinders 810, 812 with the leveling cylinder 810 under a tension load, pressure in the pilot line 842 may be relatively high, resulting in the check valve 838 being opened for relatively unimpeded flow of hydraulic fluid from the base end 830 of the leveling cylinder 810. In contrast, for example, during a commanded retraction of the cylinders 810, 812 with the leveling cylinder 810 under a compression load (e.g., during back dragging, as also discussed below), pressure in the pilot line 842 may be insufficient to open (or keep open) the check valve 838, thereby resulting in flow from the base end 830 of the leveling cylinder 810 being diverted through the restriction orifice 840. As also discussed below, this can help to avoid collapse of the leveling cylinder 810 during some operations.

In the illustrated example, the pilot line 842 connects to the leveling cylinder first line 820 downstream of the first leveling check valve 824 and the first leveling restriction orifice 826 (i.e., closer to leveling cylinder 810 and opposite the flow combiner/divider 818 from the MCV 804). However, in other embodiments, other configurations are possible. For example, the pilot line 842 can alternatively connect to the leveling cylinder first line 820 upstream of first leveling check valve 824 and the first leveling restriction orifice 826 (i.e., farther from leveling cylinder 810 and on an opposing side of the restriction orifice 826 than is shown).

The extension cylinder second line 836 provides fluid communication between the MCV 804 and the base end 832 of the extension cylinder 812. The extension cylinder second line 836 includes another flow-blocking arrangement that includes a two-position counterbalance valve 850. In particular, the counterbalance valve 850 includes a first position 854 with a spring-biased check valve and a second position 852 with a restriction orifice, is biased towards the first position 854 as a default, and is configured to be hydraulically actuated based on flow through a pilot line 856 from the flow line 822 and a counterbalance pilot line 858 from an outlet side of the first position 854.

Accordingly, the counterbalance valve 850 is configured so that the check valve of the first position 854 generally allows relatively unimpeded flow from the MCV 804 toward the base end 832 of the extension cylinder 812, such as during commanded extension of the cylinders 810, 812. And the restriction orifice of the second position 852 restricts flow from the base end 832 of the extension cylinder 812 to the MCV 804, such as during commanded retraction of the cylinders 810, 812. Further, through operation of the pilot lines 856, undesired flow in some operating conditions can be avoided. For example, at low flow hydraulic rates, during retraction of the cylinders 810, 812, leakage through the restriction orifice of the second position 852 could result in collapse of the extension cylinder 812 and a corresponding desynchronization of the cylinders 810, 812 collectively. However, due to the operation of the pilot line 856 and the default orientation of the counterbalance valve 850 in the first position 854, flow from the base end 832 of the cylinder 812 to the MCV 804 is generally prevented unless the rod end 816 of the extension cylinder 812, as reflected along the extension cylinder first line 822, is sufficiently pressurized. Thus, at relatively low flows, pressure within the pilot line 856 may initially (or otherwise) be small enough that the counterbalance valve 850 initially (or otherwise) remains in (or returns to) the first position 854, so that an appropriate pressure drop across the counterbalance valve 850 can be maintained and potential collapse of the extension cylinder 812 under compression loading can be avoided.

As noted above, different sizes, different relative locations, or other variations on aspects of the components of the hydraulic circuit 800 can be employed in other embodiments. For example, a particular range of absolute and relative sizes of the restriction orifices 826, 840 or of the second position 852 of the counterbalance valve 850 may be appropriate for a particular configuration of the cylinders 810, 812, the MCV 804, the flow combiner/divider 818, and the pump 802, for a particular range of expected operating conditions (e.g., hydraulic pressures and pressure drops), and for a power machine such as the loaders 200, 300, 400 with lift arm assemblies similar to those described above. However, other ranges of absolute and relative sizes for these or other restriction orifices may be appropriate for other configurations and expected operating conditions, or for other power machines or lift arm assemblies. Similarly, the required pilot pressure for movement of a counterbalance valve for flow from a base end of a cylinder (or otherwise) can be selected from a wide range of pressures to provide appropriate operation for particular use cases or system configurations.

The hydraulic circuit 800 as illustrated and described, and other hydraulic circuits according to the disclosure can be useful to help ensure synchronized operation of the cylinders 810, 812, or other cylinders, as well as to otherwise improve system performance, including in particular operating conditions. In some cases, for example, as further discussed below, the hydraulic circuit 800 and, in particular, the arrangement of the check valves 824, 838, the restriction orifices 826, 840, and the counterbalance valve 850 in the example flow-blocking arrangements of FIG. 8 can be useful to help ensure synchronized movement and orientation of the leveling and extension cylinders 810, 812, including during operation of a lift arm assembly similar to the lift arm assemblies 350, 450 of FIGS. 5 and 6 (e.g., with the extension cylinder 810 as an implementation of either of the cylinders 319, 419, and with the leveling cylinder as an implementation of either of the cylinders 328, 421). In other implementations, however, the leveling and extension cylinders 810, 812 can be included in different types of lift arm assemblies, including lift arm assemblies with different components, structures, linkage geometries, or other aspects than are illustrated in FIGS. 5 and 6.

Referring again to FIG. 6, when the bucket 436 is carrying a load, the force of gravity on the load urges the bucket 436 generally downward. This can result in a torsional force on the implement carrier 434, and a corresponding uneven transfer of forces from the bucket 436 to the cylinders 419, 421, via components of the two four-bar linkages. Specifically, in the configuration illustrated in FIG. 6, when the bucket 436 is weighted by a load, a clockwise torsional force (from the perspective of FIG. 6) is imparted on the implement carrier 434, which in turn imparts a tensile force on the leveling cylinder 421 and a compressive force on the extension cylinder 419. Correspondingly, for example, loading of an implement on a lift arm assembly that includes the hydraulic circuit 800 can result in a tensile force on the leveling cylinder 810 and a compressive force on the extension cylinder 812 (see FIG. 8).

Referring again to FIG. 8, when an operator commands the cylinders 810, 812 to extend, a tensile force on the leveling cylinder 810, such as may be imparted by a loaded bucket or other implement, creates a tendency for the hydraulic fluid to be drawn relatively rapidly out of the rod end 814 of the leveling cylinder 810. This, in turn, may result in (and exacerbate) cavitation within the base end 830 of the leveling cylinder 810, and can cause the leveling cylinder 810 to extend relatively rapidly. If not appropriately checked, this relatively rapid extension of the leveling cylinder 810 can cause a loss of synchronization between the cylinders 810, 812. As a result, the attitude of the implement during the commanded extension of the cylinders 810, 812 may not be appropriately maintained, the implement may tilt forward, and material on the implement can be inadvertently rolled out.

However, because of the configuration of the flow-blocking arrangement that includes the first leveling check valve 824 and the first leveling restriction orifice 826, fluid that is drawn out of the rod end 814 of the leveling cylinder 810 during a commanded extension of the cylinders 810, 812 is diverted around the check valve 824 and through the first leveling restriction orifice 826. Accordingly, flow out of the rod end 814 of the leveling cylinder 810 during extension of the cylinders 810, 812 can be substantially restricted, particularly in comparison with the relatively unimpeded flow from the rod end 816 of the extension cylinder 812 (i.e., along the extension cylinder first line 822). Thus, with appropriate configuration of the restriction orifice 826 (and other relevant components), cavitation in the base end 830 of the leveling cylinder 810 can be avoided, and appropriately synchronized movement of the cylinders 810, 812 can be maintained. In addition, passing hydraulic fluid through the restriction orifice 826 can aid in the combining performance of the combiner/divider valve 818, because it can provide pressure to appropriately balance the combiner/divider valve.

Meanwhile, still considering a commanded extension of the cylinders 810, 812, the configuration of the check valve 838 and the second extension check valve 844 allows hydraulic fluid to flow relatively freely into the base ends 830, 832 of the cylinders 810, 812 to affect the desired synchronized extension of the cylinders 810, 812. Further, as alluded to above, when the operator commands the cylinders 810, 812 to extend or retract, the lock valve 828 is configured to be moved (e.g., automatically moved) to the open position, such that hydraulic fluid can move freely out of the rod end 816 of extension cylinder 812.

Similar considerations can also apply when an implement is loaded and the operator commands the cylinders 810, 812 to retract. In this case, for example, the compressive force imparted on the extension cylinder 812 by the force of gravity on the loaded implement creates a tendency for the hydraulic fluid to be drawn relatively rapidly out of the base end 832 of the extension cylinder 812. This, in turn, may result in (and exacerbate) cavitation within the rod end 816 of the extension cylinder 812, and can cause the extension cylinder 812 to compress relatively rapidly. If not appropriately checked, this relatively rapid compression of the extension cylinder 812 can also cause a loss of synchronization between the cylinders 810, 812. As a result, the attitude of the implement during the commanded retraction of the cylinders 810, 812 may not be appropriately maintained, the implement may tilt forward, and material on the implement can be inadvertently rolled out.

However, because of the configuration of the second extension check valve 844 and the second extension restriction orifice 846, fluid that is drawn out of the base end 832 of the extension cylinder 812 during a commanded retraction of the cylinder 810, 812 is diverted around the check valve 844 and through second extension orifice 846. Accordingly, flow out of the base end 832 of the extension cylinder 812 can be substantially restricted, particularly in comparison with relatively unimpeded flow from the base end 830 of the leveling cylinder 810, due to activation of the check valve 838 via the pilot line 842 (as also discussed below). Thus, with appropriate configuration of the restriction orifice 846 (and other relevant components, such as the pilot-operated check valve 838), cavitation in the rod end 816 of the extension cylinder 812 can be avoided, and appropriately synchronized movement of the cylinders 810, 812 can be maintained. In addition, passing hydraulic fluid through the restriction orifice 826 can aid in the dividing performance of the combiner/divider valve 818, because it can provide pressure to appropriately balance the combiner/divider valve.

Meanwhile, still considering a commanded retraction of the cylinders 810, 812, the configuration of the first leveling check valve 824 and the lock valve 828 allows hydraulic fluid to flow freely into the rod ends 814, 816 of the cylinders 810, 812. As noted above, the lock valve 828 can be controlled to open when movement (e.g., retraction) of the cylinders 810, 812 is commanded, thus allowing hydraulic fluid to flow freely into or out of the rod end 816 of the cylinder 812. Further, the tensile force maintained on the leveling cylinder 810 by the bucket 436, in combination with pressurization resulting from the commanded retraction will generally maintain a relatively elevated pressure of the hydraulic fluid in the leveling cylinder first line 820. Because the pilot line 842 is in fluid communication with the leveling cylinder first line 820, this relatively elevated pressure can cause the check valve 838 to remain open, as also noted above. As such, hydraulic fluid can also flow relatively freely out of the base end 830 of leveling cylinder 810 to the MCV 804, bypassing the restriction orifice 840 to flow through the open check valve 838, and synchronization of the cylinders 810, 812 can be maintained.

In some embodiments, synchronization can also be maintained during other commanded movements. For example, during back dragging operations, the leveling cylinder 810 can become loaded in compression and the extension cylinder 812 can become loaded in tension during a commanded retraction of the cylinders 810, 812. For similar reasons as discussed above, this can tend to cause cavitation in the rod end 814 of the leveling cylinder 810, relatively rapid flow of hydraulic fluid out of the base end 830 of the leveling cylinder 810, and the resulting loss of the desired synchronization of the leveling and extension cylinders 810, 812.

However, because the leveling cylinder 810 is being compressively loaded by the implement, pressure within the leveling cylinder first line 820 correspondingly drops, despite pressurized flow into the leveling cylinder first line 820 from the MCV 804 via the flow combiner/divider 818. As such, with sufficient compressive loading of the leveling cylinder 810 (e.g., as may be sufficient to substantially increase the risk of cavitation), the pressure within the pilot line 842 will be reduced until it is no longer sufficiently high to maintain the check valve 838 in an open state. With the check valve 838 thus closed, fluid flowing out of the base end 830 of the leveling cylinder 810 toward the MCV 704 is diverted around the check valve 838 to pass through the second leveling restriction orifice 840. Accordingly, flow out of the base end 830 of the leveling cylinder 810 can be substantially restricted, with corresponding reduction of the risk of cavitation in the leveling cylinder 810. Thus, with appropriate configuration of the restriction orifice 840 (and other relevant components, such as the check valve 838), cavitation in the rod end 814 of the leveling cylinder 810 can be avoided, and appropriately synchronized movement of the cylinders 810, 812 can be maintained.

Appropriate control may also be needed to maintain a synchronized orientation of leveling and extension cylinders when no movement of the cylinders is commanded. For example, when no movement is being commanded for the cylinders 810, 812 (i.e., when there is no commanded fluid flow in the hydraulic circuit 800), various external forces can act on the cylinders 810, 812. These forces can push flow through the flow combiner/divider 818, which may tend to function best only during commanded hydraulic flow, and can thereby urge the cylinders 810, 812 out of a desired synchronized orientation.

To prevent loss of synchronization of a set of cylinders, as also alluded to above, a lock valve can be provided in order to prevent certain hydraulic flows when no movement of the cylinders is commanded. For example, the lock valve 828 in the hydraulic circuit 800 is configured to selectively block the flow path between the rod end 816 of the extension cylinder 812 and the rod end 814 of the leveling cylinder 810. Accordingly, the lock valve 828 can prevent flow between the rod ends 814, 816 of the two cylinders 810, 812, via a connection in the flow combiner/divider 818, and can thereby help to maintain the synchronized orientation of the cylinders 810, 812 when flow is not commanded. Further, as noted above, the solenoid of the lock valve 828 can be configured to be energized whenever flow is commanded for the hydraulic circuit 800 (i.e., whenever movement of the cylinders 810, 812 is commanded) in order to move the lock valve 828 to the open position and thereby permit flow between the rod ends 814, 816 of the cylinders 810, 812. Also as noted above, although the lock valve solenoid 828 is illustrated as an electrically controlled valve, other configurations are possible, including lock valves that are configured to be controlled via pilot pressure to unlock (i.e., to permit flow) when movement of the relevant cylinders is commanded.

As also noted above, particular sizes and other aspects of the restriction orifices 826, 840 and of the restriction orifice in the second position 852 of the counterbalance valve 850 can be selected in order to appropriately accommodate expected flow rates, pressure drops, loading, and other relevant aspects of particular systems and particular operations. Similarly, other components, such as the check valves 824, 838, the check valve in the first position 854 of the counterbalance valve 850, the pump 802, the MCV 804, the flow combiner/divider 818, or other orifices, valves, check valves, pumps, cylinders, and so on can also be customized as appropriate for particular power machines or operating conditions.

Figure 9:
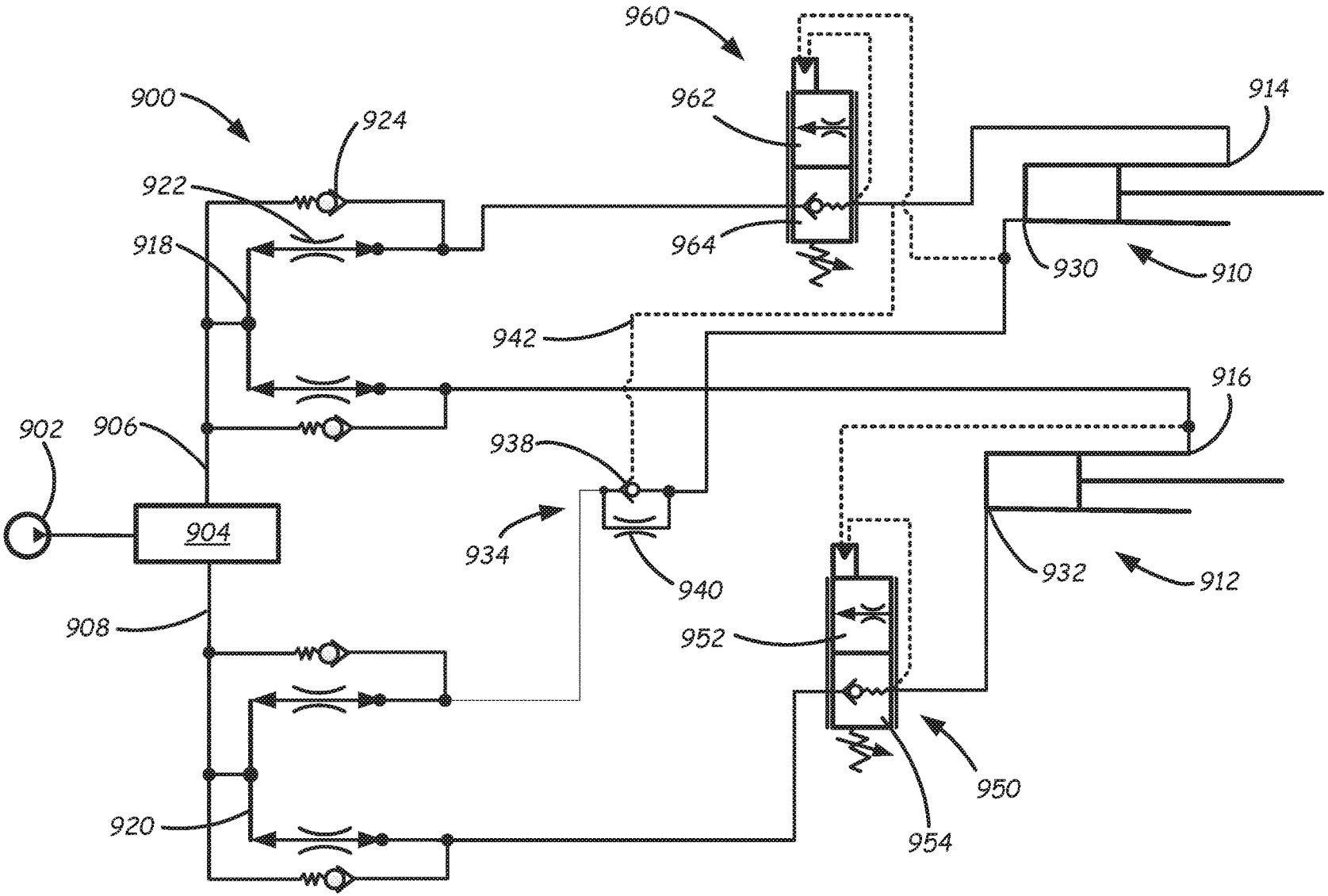
FIG. 9 is a diagrammatic illustration of a hydraulic leveling circuit according to some embodiments disclosed in this specification.

FIG. 9 shows an example hydraulic circuit 900 according to some embodiments of the disclosure, which is one particular example of a work actuator circuit of the type illustrated in FIG. 4 and which can be implemented on power machines such as the type illustrated in FIG. 1, including articulated loaders such as the type illustrated in FIG. 2. Similarly to the hydraulic circuits 700, 800 in many ways, the hydraulic circuit 900 can provide appropriate control of hydraulic flow for self-leveling systems, including systems similar to those illustrated in FIGS. 5 and 6 and others. Correspondingly, in some cases, the hydraulic circuit 900 or other hydraulic circuits according to this disclosure can be used with the lift arm assemblies 350, 450 as illustrated in FIGS. 5 and 6 or other lift arm assemblies, including those having different geometries and components than the lift arm assemblies 350, 450 of FIGS. 5 and 6.

In this regard, similarly to the hydraulic circuit 800, the hydraulic circuit 900 includes an implement pump 902 and a main control valve (MCV) 904 that can selectively direct hydraulic flow along either of hydraulic flow lines 906, 908 in order to control synchronized movement of a leveling cylinder 910 and an extension cylinder 912. In particular, during commanded retraction of the cylinder 910, 912, hydraulic flow is directed by the MCV 904 along the flow line 906 to be divided by a flow divider 918 before reaching rod ends 914, 916 of the cylinders 910, 912. In contrast, during commanded extension of the cylinders 910, 912, hydraulic flow is directed by the MCV 904 along the flow line 908 to be divided by a flow divider 920 before reaching base ends 930, 932 of the cylinders 910, 912.

Conversely, during commanded extension of the cylinders 910, 912, flow from the rod ends 914, 916 of the cylinders 910, 912 bypasses the flow divider 918, and during commanded retraction of the cylinders 910, 912, flow from the base ends 930, 932 of the cylinders 910, 912 bypasses the flow divider 920. For example, flow from the rod end 914 of the leveling cylinder 910 during extension of the cylinders 910, 912 passes through a directional bypass that includes a spring-biased check valve 924 that is arranged in parallel with a flow restriction 922 of the flow divider 918, but not included in the flow divider 918. Similarly, flow from the rod end 916 of the extension cylinder 912 and from the base ends 930, 932 of the leveling and extension cylinders 910, 912 during extension and retraction of the cylinders 910, 912, respectively, will pass around the flow dividers 918, 920 through associated check valves (not numbered). In contrast, flow from the MCV 904 to the rod ends 914, 916 of the cylinder 910, 912 or from the MCV 904 to the base ends 930, 932 of the cylinders 910, 912 would be blocked by the check valve 924 and other similarly placed check valves (not numbered) and thereby routed through the restriction orifices of the flow dividers 918, 920 (e.g., the restriction orifice 922) to be appropriately divided between the cylinders 910, 912. Among other benefits, this arrangement can allow the flow dividers 918, 920 to serve as flow dividers only (i.e., not also as flow combiners), which may improve overall system functionality due to the tendency of some flow dividers/combiners to work less well as combiners than as dividers. Further, the reduced restriction of flow to the MCV 904 through the check valves outside of the flow dividers 918, 920 (e.g., the check valve 924), rather than through the restriction orifices of the flow dividers 918, 920 (e.g., the restriction orifice 922) can help to maintain stability for flow-blocking arrangements configured as counterbalance valves, including the counterbalance valves further discussed below.

As alluded to above, the hydraulic circuit 900 includes a set of three flow-blocking arrangements that are configured similarly to flow-blocking arrangements discussed above with respect to the hydraulic circuit 800 of FIG. 8. In particular, a first flow-blocking arrangement is configured as a counterbalance valve 950 between the flow divider 920 and the base end 932 of the extension cylinder 912, a second flow-blocking arrangement is configured as a counterbalance valve 960 between the flow divider 918 and the rod end 914 of the leveling cylinder 910, and a third flow-blocking arrangement is configured as a restriction orifice 940 in parallel with a pilot-operated check valve 938 along a flow path 934 between the flow divider 920 and the base end 930 of the leveling cylinder 910.

Generally, the flow-blocking arrangements are configured and operate similarly to corresponding flow-blocking arrangements in FIG. 8. For example, similarly to the counterbalance valve 850, the counterbalance valve 950 includes a first, default position 954 with a check valve that permits flow to the base end 932 of the extension cylinder 912, and a second position 952 with a restriction orifice to restrict flow from the base end 932 of the extension cylinder 912. Further, the counterbalance valve 950, and is configured to be actuated based on pressure along the flow path 906 (e.g., at the rod end 916 of the extension cylinder 912). Thus, the counterbalance valve 950 can generally operate similarly to the counterbalance valve 850, as described in detail above. Likewise, the counterbalance valve 960 includes a first, default position 964 with a check valve that permits flow to the rod end 914 of the leveling cylinder 910, and a second position 962 with a restriction orifice to restrict flow from the rod end 914 of the leveling cylinder 910. Further, the counterbalance valve 960 is configured to be actuated based on pressure along the flow path 908. Thus, the counterbalance valve 960 can operate similarly to the counterbalance valve 850, but with respect to the rod end 914 of the leveling cylinder 910 and pressurization of the flow line 908 (e.g., at the base end 930 of the leveling cylinder 910), and can thereby provide similar overall functionality as the parallel check valve 824 and restriction orifice 826 (see FIG. 8). The restriction orifice 940 and the pilot-operated check valve 938 can also operate similarly to the restriction orifice 840 and the pilot-operated check valve 838 that are arranged in parallel in the hydraulic circuit 800 (see FIG. 8).

As noted for other components discussed above, some flow dividers may exhibit a different or more complex configuration than is illustrated for the flow dividers 918, 920. Correspondingly, the principles discussed herein with regard to the hydraulic circuit 900 can be still be usefully employed in hydraulic circuits that include differently configured flow dividers or other components.

Although the examples above focus on synchronized movement of cylinders, some similar arrangements can be used for other purposes. For example, similar hydraulic circuits can be used to ensure a controlled desynchronized movement of cylinders, such as extension or retraction of one cylinder by a fraction of or excess percentage relative to extension or retraction of another cylinder. In some embodiments, this controlled desynchronized movement can be implemented using hydraulic circuits similar to those discussed herein, but with differently sized restriction orifices. For example, restriction orifices such as the restriction orifices 726, 740, 746 can be sized in some cases to provide a ratio of flow for synchronized movement and can be sized in other cases to provide a ratio of flow for non-synchronized movement. Correspondingly, although some examples herein describe fixed orifices arranged to provide a desired pressure drop, other embodiments can include one or more variable orifices (e.g., located similarly to the restriction orifices 726, 740, 746) that can be adjusted to provide desired pressure drops for particular operating conditions.

Although the examples above focus on synchronized movement of cylinders, some similar arrangements can be used for other purposes. For example, similar hydraulic circuits can be used to ensure a controlled desynchronized movement of cylinders, such as extension or retraction of one cylinder by a fraction of or excess percentage relative to extension or retraction of another cylinder. In some embodiments, this controlled desynchronized movement can be implemented using hydraulic circuits similar to those discussed herein, but with differently sized restriction orifices. For example, restriction orifices such as the restriction orifices 726, 740, 746 can be sized in some cases to provide a ratio of flow for synchronized movement and can be sized in other cases to provide a ratio of flow for non-synchronized movement. Correspondingly, although some examples herein describe fixed orifices arranged to provide a desired pressure drop, other embodiments can include one or more variable orifices (e.g., located similarly to the restriction orifices 726, 740, 746) that can be adjusted to provide desired pressure drops for particular operating conditions.

Some discussion above, focuses in particular on control and synchronization of sets of leveling and extension cylinders (e.g., the cylinders 710, 712 of FIG. 7) for control of single implements or implement carriers. In some embodiments, however, the disclosed hydraulic circuits, such as the hydraulic circuit 700, can be configured to control multiple implements or actuators, to form a part of larger hydraulic assemblies, to control synchronization of other arrangements of actuators, or to otherwise vary from the examples above. For example, variations on the hydraulic circuit 700 can be configured to control work actuators other than the cylinders 710, 712 on any variety of power machines.

Although the present invention has been described with reference to preferred embodiments, workers skilled in the art will recognize that changes may be made in form and detail to the disclosed embodiments without departing from the spirit and scope of the concepts discussed herein.

What is claimed is:

1. A hydraulic assembly for controlling position of portions of a lift arm assembly, the lift arm assembly including a main lift arm portion, an extendable lift arm portion configured to be extended relative to the main lift arm portion and an implement interface for supporting an implement, the hydraulic assembly comprising:

a leveling cylinder configured to adjust an attitude of the implement supported by the implement interface relative to the extendable lift arm portion;

an extension cylinder configured to move the extendable lift arm portion relative to the main lift arm portion;

a main control valve configured to control commanded movement of the leveling and extension cylinders by selectively directing flow along a first hydraulic flow path to rod ends of the extension and leveling cylinders or along a second hydraulic flow path to base ends of the leveling and extension cylinders;

a flow combiner/divider along one of the first or second hydraulic flow paths, the flow combiner/divider configured to divide hydraulic flow to, respectively, one of (i) the rod ends of the extension and leveling cylinders during retraction of the extension and leveling cylinders or (ii) the base ends of the extension and leveling cylinders during extension of the extension and leveling cylinders, and to combine hydraulic flow from, respectively, one of (i) the rod ends of the extension and leveling cylinders during extension of the extension and leveling cylinders or (ii) the base ends of the extension and leveling cylinders during retraction of the extension and leveling cylinders, for synchronized operation of the leveling and extension cylinders; and a first flow-blocking arrangement positioned along the first hydraulic flow path and a second flow-blocking arrangement positioned along the second hydraulic flow path, the first flow-blocking arrangement configured to restrict flow from the rod end of the leveling cylinder and the second flow-blocking arrangement configured to restrict flow from the base end of the extension cylinder during movement of the leveling and extension cylinders;

wherein one or more of the first or second flow-blocking arrangements includes a restriction orifice in parallel with a check valve, the check valve being configured to permit flow through the check valve to one or more of, respectively, the rod end of the leveling cylinder during retraction of the leveling and extension cylinders or the base end of the extension cylinder during extension of the leveling and extension cylinders.

2. The hydraulic assembly of claim 1, wherein the second flow-blocking arrangement includes a counterbalance valve having:

a first position with a check valve configured to permit flow through the check valve to the base end of the extension cylinder during extension of the leveling and extension cylinders; and a second position with a flow orifice configured to restrict flow from the base end of the extension cylinder during retraction of the leveling and extension cylinders.

3. The hydraulic assembly of claim 2, wherein the check valve is biased closed.

4. The hydraulic assembly of claim 2, wherein the counterbalance valve is a hydraulically actuated valve, the first position is a default position, and the counterbalance valve is configured to be moved from the first position to the second position by pressurization of the first hydraulic flow path.

5. The hydraulic assembly of claim 4, wherein the counterbalance valve is configured to be moved from the first position to the second position by pressurization of the first flow path between the flow combiner/divider and the rod end of the extension cylinder.

6. The hydraulic assembly of claim 1, further comprising:

a lock valve along the first hydraulic flow path configured to move to a first configuration during commanded movement of the extension and leveling cylinders and to a second configuration when there is no commanded movement of the extension and leveling cylinders;

wherein the first configuration of the lock valve permits hydraulic flow between the rod ends of the extension and leveling cylinders; and wherein the second configuration of the lock valve blocks hydraulic flow between the rod ends of the extension and leveling cylinders.

7. The hydraulic assembly of claim 1, further comprising:

a third flow-blocking arrangement positioned along the second hydraulic flow path, the third flow-blocking arrangement configured to restrict flow from the base end of the leveling cylinder during retraction of the leveling and extension cylinders when the leveling cylinder is under compression.

8. The hydraulic assembly of claim 7, wherein the third flow-blocking arrangement includes a restriction orifice in parallel with a pilot-operated check valve that is configured to block flow from the base end of the leveling cylinder in a default state and to be:

opened by pressurization of the first hydraulic flow path, during retraction of the leveling and extension cylinders, to permit flow through the pilot-operated check valve from the base end of the leveling cylinder; and closed, during retraction of the leveling and extension cylinders, upon compression loading of the leveling cylinder.

9. A hydraulic assembly for controlling position of portions of a lift arm assembly, the lift arm assembly including a main lift arm portion, an extendable lift arm portion configured to be extended relative to the main lift arm portion, and an implement interface for supporting an implement, the hydraulic assembly comprising:

a leveling cylinder configured to adjust an attitude of the implement relative to the extendable lift arm portion, causing one of a tensile load or a compression load on the leveling cylinder depending on a load introduced by an implement attached to the implement interface;

an extension cylinder configured to move the extendable lift arm portion relative to the main lift arm portion;

a main control valve configured to control commanded movement of the extension and leveling cylinders by selectively directing flow along a first hydraulic flow path to rod ends of the extension and leveling cylinders or along a second hydraulic flow path to base ends of the leveling and extension cylinders;

a flow combiner/divider along one of the first or second hydraulic flow paths, the flow combiner/divider configured to divide hydraulic flow to, respectively, one of (i) the rod ends of the extension and leveling cylinders during retraction of the extension and leveling cylinders or (ii) the base ends of the extension and leveling cylinders during extension of the extension and leveling cylinders, and to combine hydraulic flow from, respectively, one of (i) the rod ends of the extension and leveling cylinders during extension of the extension and leveling cylinders or (ii) the base ends of the extension and leveling cylinders during retraction of the extension and leveling cylinders, including for synchronized operation of the leveling and extension cylinders when the extension cylinder is under tension; and a lock valve arranged along one of the first hydraulic flow path and the second hydraulic flow path;

the lock valve being configured to be moved to a first configuration during commanded movement of the extension and leveling cylinders and to a second configuration when there is no commanded movement of the extension and leveling cylinders;

the first configuration of the lock valve permitting hydraulic flow between the rod ends of the extension and leveling cylinders; and the second configuration of the lock valve blocking hydraulic flow between the rod ends of the extension and leveling cylinders.

10. The hydraulic assembly of claim 9, wherein a first flow-blocking arrangement is positioned along the first hydraulic flow path and a second flow-blocking arrangement is positioned along the second hydraulic flow path, the first flow-blocking arrangement configured to restrict flow from the rod end of the leveling cylinder during extension of the leveling and extension cylinders and the second flow-blocking arrangement configured to restrict flow from the base end of the extension cylinder during retraction of the leveling and extension cylinders.

11. The hydraulic assembly of claim 10, wherein the second flow-blocking arrangement includes a counterbalance valve having:

a first position with a spring-biased check valve configured to permit flow through the check valve to the base end of the extension cylinder during extension of the leveling and extension cylinders; and a second position with a flow orifice to restrict flow from the base end of the extension cylinder during retraction of the leveling and extension cylinders.

12. The hydraulic assembly of claim 11, wherein the counterbalance valve is a hydraulically actuated valve and is configured to be moved from the first position to the second position by pressurization of the first hydraulic flow path when the lock valve is in the first configuration, during retraction of the leveling and extension cylinders.

13. The hydraulic assembly of claim 10, wherein one or more of the first or second flow-blocking arrangements includes a restriction orifice in parallel with a check valve, the check valve configured to permit flow through the check valve to one or more of, respectively, the rod end of the leveling cylinder during retraction of the leveling and extension cylinders or the base end of the extension cylinder during extension of the leveling and extension cylinders.

14. The hydraulic assembly of claim 10, further comprising:

a third flow-blocking arrangement positioned along the second hydraulic flow path, the third flow-blocking arrangement including a restriction orifice in parallel with a pilot-operated check valve that is configured to block flow from the base end of the leveling cylinder in a default state and to be:

opened by pressurization of the first hydraulic flow path, during retraction of the leveling and extension cylinders, to permit flow through the pilot-operated check valve from the base end of the leveling cylinder; and closed, during retraction of the leveling and extension cylinders, upon compression loading of the leveling cylinder.

15. A hydraulic assembly for controlling position of portions of a lift arm assembly, the lift arm assembly including a main lift arm portion, an extendable lift arm portion configured to be extended relative to the main lift arm portion, and an implement interface for supporting an implement, the hydraulic assembly comprising:

a leveling cylinder configured to adjust an attitude of the implement relative to the extendable lift arm portion, causing one of a tensile load or a compression load on the leveling cylinder depending on a load introduced by an implement attached to the implement interface;

an extension cylinder configured to move the extendable lift arm portion relative to the main lift arm portion, the extension cylinder being under a compression load;

a main control valve configured to control commanded movement of the leveling and extension cylinders by selectively directing flow along a first hydraulic flow path to rod ends of the extension and leveling cylinders or along a second hydraulic flow path to base ends of the leveling and extension cylinders;

a first flow divider along the first hydraulic flow path configured to divide hydraulic flow to the rod ends of the extension and leveling cylinders during retraction of the extension and leveling cylinders, for synchronized operation of the extension and leveling cylinders;

a second flow divider along the second hydraulic flow path configured to divide hydraulic flow to the base ends of the extension and leveling cylinders during extension of the extension and leveling cylinders, for synchronized operation of the extension and leveling cylinders;

a first flow-blocking arrangement along the first hydraulic flow path configured to restrict flow from the rod end of the leveling cylinder, during movement of the extension and leveling cylinders; and a second flow-blocking arrangement along the second hydraulic flow path configured to restrict flow from the base end of the extension cylinder, during movement of the extension and leveling cylinders, wherein the first flow divider includes a directional bypass to allow flow from the first flow-blocking arrangement to bypass the flow divider.

16. The hydraulic assembly of claim 15, wherein one of the first or second flow-blocking arrangements includes a first counterbalance valve having:

a first position with a check valve configured to permit flow through the check valve to one of, respectively, the rod end of the leveling cylinder during retraction of the extension and leveling cylinders, or the base end of the extension cylinder during extension of the extension and leveling cylinders; and a second position with a flow orifice configured to restrict flow from one of, respectively, the rod end of the leveling cylinder during extension of the extension and leveling cylinders, or the base end of the extension cylinder during retraction of the extension and leveling cylinders.

17. The hydraulic assembly of claim 16, wherein the first counterbalance valve is a hydraulically actuated valve, the first position is a default position, and the first counterbalance valve is configured to be moved from the first position to the second position by pressurization of, respectively, the second hydraulic flow path or the first hydraulic flow path.

18. The hydraulic assembly of claim 16, wherein the other of the first or second flow-blocking arrangements includes a second counterbalance valve having:

a first position with a check valve configured to permit flow to the other of, respectively, the rod end of the leveling cylinder during retraction of the extension and leveling cylinders, or the base end of the extension cylinder during extension of the extension and leveling cylinders; and a second position with a flow orifice configured to restrict flow from the other of, respectively, the rod end of the leveling cylinder during extension of the extension and leveling cylinders, or the base end of the extension cylinder during retraction of the extension and leveling cylinders.

19. The hydraulic assembly of claim 15, further comprising:

a third flow-blocking arrangement along the second hydraulic flow path configured to restrict flow from the base end of the leveling cylinder, during retraction of the extension and leveling cylinders, upon compressive loading of the leveling cylinder.

20. A hydraulic assembly for controlling position of portions of a lift arm assembly, the lift arm assembly including a main lift arm portion, an extendable lift arm portion configured to be extended relative to the main lift arm portion and an implement interface for supporting an implement, the hydraulic assembly comprising:

a leveling cylinder configured to adjust an attitude of the implement supported by the implement interface relative to the extendable lift arm portion, causing one of a tensile load or a compression load on the leveling cylinder depending on a load introduced by an implement attached to the implement interface;

an extension cylinder configured to move the extendable lift arm portion relative to the main lift arm portion, the extension cylinder;

a main control valve configured to control commanded movement of the leveling and extension cylinders by selectively directing flow along a first hydraulic flow path to rod ends of the extension and leveling cylinders or along a second hydraulic flow path to base ends of the leveling and extension cylinders;

a flow combiner/divider along one of the first or second hydraulic flow paths, the flow combiner/divider configured to divide hydraulic flow to, respectively, one of (i) the rod ends of the extension and leveling cylinders during retraction of the extension and leveling cylinders or (ii) the base ends of the extension and leveling cylinders during extension of the extension and leveling cylinders, and to combine hydraulic flow from, respectively, one of (i) the rod ends of the extension and leveling cylinders during extension of the extension and leveling cylinders or (ii) the base ends of the extension and leveling cylinders during retraction of the extension and leveling cylinders, for synchronized operation of the leveling and extension cylinders; and a first flow-blocking arrangement positioned along the first hydraulic flow path, a second flow-blocking arrangement positioned along the second hydraulic flow path, and a third flow-blocking arrangement positioned along the second hydraulic flow path;

the first flow-blocking arrangement configured to restrict flow from the rod end of the leveling cylinder during extension of the leveling and extension cylinders when the leveling cylinder is under tension and the extension cylinder is under compression;

the second flow-blocking arrangement configured to restrict flow from the base end of the extension cylinder during retraction of the leveling and extension cylinders when the leveling cylinder is under tension and the extension cylinder is under compression; and the third flow-blocking arrangement configured to restrict flow from the base end of the leveling cylinder during retraction of the leveling and extension cylinders when the leveling cylinder is under compression, wherein a plurality of the first, second, and third flow-blocking arrangements include a restriction orifice in parallel with a check valve.

21. The hydraulic assembly of claim 20, wherein the second flow-blocking arrangement includes a hydraulically actuated counterbalance valve that is configured to be moved from a first position to a second position by pressurization of the first hydraulic flow path during commanded retraction of the leveling and extension cylinders;

wherein the first position is a default position and includes a spring-biased check valve configured to permit flow through the check valve to the base end of the extension cylinder during extension of the leveling and extension cylinders; and wherein the second position includes a flow orifice to restrict flow from the base end of the extension cylinder during retraction of the leveling and extension cylinders.

22. The hydraulic assembly of claim 21, wherein the plurality of the first, second, and third flow-blocking arrangements that include the restriction orifice in parallel with the check valve includes the third flow-blocking arrangement; and wherein the check valve of the third flow-blocking arrangement is a pilot-operated check valve in parallel with the restriction orifice, the pilot-operated check valve being configured to block flow from the base end of the leveling cylinder in a default state and to be:

opened by pressurization of the first hydraulic flow path, during retraction of the leveling and extension cylinders when the leveling cylinder is under tension loading, to permit flow through the pilot-operated check valve from the base end of the leveling cylinder; and closed, during retraction of the leveling and extension cylinders when the leveling cylinder is under compression loading.

23. A hydraulic assembly for controlling position of portions of a lift arm assembly, the lift arm assembly including a main lift arm portion, an extendable lift arm portion configured to be extended relative to the main lift arm portion and an implement interface for supporting an implement, the hydraulic assembly comprising:

a leveling cylinder configured to adjust an attitude of the implement supported by the implement interface relative to the extendable lift arm portion;

an extension cylinder configured to move the extendable lift arm portion relative to the main lift arm portion;

a main control valve configured to control commanded movement of the leveling and extension cylinders by selectively directing flow along a first hydraulic flow path to rod ends of the extension and leveling cylinders or along a second hydraulic flow path to base ends of the leveling and extension cylinders;

a flow combiner/divider along one of the first or second hydraulic flow paths, the flow combiner/divider configured to divide hydraulic flow to, respectively, one of (i) the rod ends of the extension and leveling cylinders during retraction of the extension and leveling cylinders or (ii) the base ends of the extension and leveling cylinders during extension of the extension and leveling cylinders, and to combine hydraulic flow from, respectively, one of (i) the rod ends of the extension and leveling cylinders during extension of the extension and leveling cylinders or (ii) the base ends of the extension and leveling cylinders during retraction of the extension and leveling cylinders, for synchronized operation of the leveling and extension cylinders; and a first flow-blocking arrangement positioned along the first hydraulic flow path and a second flow-blocking arrangement positioned along the second hydraulic flow path, the first flow-blocking arrangement configured to restrict flow from the rod end of the leveling cylinder and the second flow-blocking arrangement configured to restrict flow from the base end of the extension cylinder during movement of the leveling and extension cylinders, the second flow-blocking arrangement including a counterbalance valve having:

a first position with a check valve configured to permit flow through the check valve to the base end of the extension cylinder during extension of the leveling and extension cylinders; and a second position with a flow orifice configured to restrict flow from the base end of the extension cylinder during retraction of the leveling and extension cylinders.

24. A hydraulic assembly for controlling position of portions of a lift arm assembly, the lift arm assembly including a main lift arm portion, an extendable lift arm portion configured to be extended relative to the main lift arm portion and an implement interface for supporting an implement, the hydraulic assembly comprising:

a leveling cylinder configured to adjust an attitude of the implement supported by the implement interface relative to the extendable lift arm portion;

an extension cylinder configured to move the extendable lift arm portion relative to the main lift arm portion;

a main control valve configured to control commanded movement of the leveling and extension cylinders by selectively directing flow along a first hydraulic flow path to rod ends of the extension and leveling cylinders or along a second hydraulic flow path to base ends of the leveling and extension cylinders;

a flow combiner/divider along one of the first or second hydraulic flow paths, the flow combiner/divider configured to divide hydraulic flow to, respectively, one of (i) the rod ends of the extension and leveling cylinders during retraction of the extension and leveling cylinders or (ii) the base ends of the extension and leveling cylinders during extension of the extension and leveling cylinders, and to combine hydraulic flow from, respectively, one of (i) the rod ends of the extension and leveling cylinders during extension of the extension and leveling cylinders or (ii) the base ends of the extension and leveling cylinders during retraction of the extension and leveling cylinders, for synchronized operation of the leveling and extension cylinders;

a first flow-blocking arrangement positioned along the first hydraulic flow path and configured to restrict flow from the rod end of the leveling cylinder;

a second flow-blocking arrangement positioned along the second hydraulic flow path and configured to restrict flow from the base end of the extension cylinder during movement of the leveling and extension cylinders; and a third flow-blocking arrangement positioned along the second hydraulic flow path and configured to restrict flow from the base end of the leveling cylinder during retraction of the leveling and extension cylinders when the leveling cylinder is under compression, the third flow-blocking arrangement including a restriction orifice in parallel with a pilot-operated check valve that is configured to block flow from the base end of the leveling cylinder in a default state and to be:

opened by pressurization of the first hydraulic flow path, during retraction of the leveling and extension cylinders, to permit flow through the pilot-operated check valve from the base end of the leveling cylinder; and closed, during retraction of the leveling and extension cylinders, upon compression loading of the leveling cylinder.

* * * * *